US006503068B2

(12) United States Patent
Kojima et al.

(10) Patent No.: US 6,503,068 B2
(45) Date of Patent: Jan. 7, 2003

(54) VARIABLE CAPACITY TYPE PUMP

(75) Inventors: Eiichi Kojima, Kanagawa (JP); Chaojiu Wang, Tochigi (JP); Kiyoshi Ando, Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/999,559

(22) Filed: Oct. 19, 2001

(65) Prior Publication Data

US 2002/0064471 A1 May 30, 2002

(30) Foreign Application Priority Data

Nov. 29, 2000 (JP) ..... 2000-363737

(51) Int. Cl.[7] ..... F04C 15/04

(52) U.S. Cl. ..... 418/30; 418/150; 418/31; 418/259; 418/269; 417/204; 417/220; 417/315

(58) Field of Search ..... 418/30, 31, 150, 418/259, 269; 417/204, 220, 315

(56) References Cited

U.S. PATENT DOCUMENTS 4,578,948 A * 4/1986 Hutson et al. ..... 417/204
4,616,984 A * 10/1986 Inagaki et al. ..... 418/150
4,738,603 A 4/1988 Hattori
5,490,770 A * 2/1996 Oogushi ..... 418/30

FOREIGN PATENT DOCUMENTS

| | | | | |
|---|---|---|---|---|
| EP | 49838 A | * | 4/1982 | ..... F04C/15/04 |
| JP | 05223064 A | * | 8/1993 | ..... F04C/15/04 |
| JP | 05248362 A | * | 9/1993 | ..... F04C/2/344 |
| JP | 06173863 A | * | 6/1994 | ..... F04C/2/344 |
| JP | 06272675 A | * | 9/1994 | ..... F04C/2/344 |
| JP | 914155 | | 1/1997 | |

* cited by examiner

*Primary Examiner*—Thomas Denion
*Assistant Examiner*—Theresa Trieu
(74) *Attorney, Agent, or Firm*—Orum & Roth

(57) ABSTRACT

In a variable capacity type pump, in the inner diameter of a cam ring, an inner diameter of a portion forming a middle section between a suction section and a discharge section in a pump chamber is constituted by a negative slope curve in which an end portion of a suction port is set to be a start point, and a complete round curve and a negative slope curve are connected by a high-order curve.

12 Claims, 16 Drawing Sheets

SCHEMATIC VIEW OF CAM RING

DYNAMIC RADIUS OF FIRST EMBODIMENT

DYNAMIC RADIUS NEAR BOTTOM DEAD CENTER OF FIRST EMBODIMENT

DYNAMIC RADIUS NEAR TOP DEAD CENTER OF FIRST EMBODIMENT

DYNAMIC RADIUS OF SECOND EMBODIMENT

DYNAMIC RADIUS NEAR BOTTOM DEAD CENTER OF SECOND EMBODIMENT

DYNAMIC RADIUS NEAR TOP DEAD CENTER OF SECOND EMBODIMENT

VARIABLE CAPACITY TYPE PUMP

BACKGROUND OF THE INVENTION

1. Field of the Invention

The present invention relates to a variable capacity type pump used in a power steering apparatus for a motor vehicle or the like.

2. Description of the Related Art

Conventionally, a variable capacity type pump used in a power steering apparatus for a motor vehicle or the like, as shown in Japanese Patent Application Laid-Open (JP-A) No. 9-14155, has a structure which has a cam ring being eccentric with respect to a rotor arranged in a pump casing so as to be rotated, forms a pump chamber between a cam ring and an outer peripheral portion of the rotor, increases an eccentricity amount of the cam ring with respect to the rotor during low speed rotation of the pump, thereby increasing the capacity of the pump chamber and increasing the discharge amount of a working fluid, and reduces the eccentricity amount of the cam ring with respect to the rotor at a time of a high speed rotation of the pump, thereby reducing the capacity of the pump chamber and reducing the discharge amount of the working fluid.

In the conventional art mentioned above, in order to reduce the pressure pulsation of the variable capacity type vane pump, and the vibration and sound induced therefrom, spaces of two closed portions comprised of a first closed portion formed by closing a suction port and a discharge port at a bottom dead center and a second closed portion formed by closing the discharge port and the suction port at a top dead center, among the pump chamber surrounded by the cam ring and the rotor are both formed as a space surrounded by a concentric circle around the center of rotation of the rotor under a maximum eccentric condition of the cam ring (in other words, a dynamic radius of the vane is set to be constant). In the conventional art, since a distance between the rotor and the cam ring in the closed portion is constant, an over compression on the basis of a capacity change of the pump chamber is not generated, so that it is possible to prevent a pulsation phenomenon on the basis of moving apart of the vane.

In the conventional art, since the structure is made such that the distance between the rotor and the cam ring becomes constant (that is, concentric) in the closed portion during the maximum eccentricity of the cam ring when the pump rotates at a low speed, an inner periphery of the cam ring and an outer periphery of the rotor are not concentric when the eccentricity amount becomes small during high speed rotation, so that it is impossible to prevent the vane from moving apart, and a great pressure pulsation caused by an increase of leakage in a gap at a front end of the vane is generated. Further, in the conventional art, it is considered that the moving apart of the vane is caused by the over compression within the closed chamber. However, by right as described below, the moving apart of the vane is mainly caused by an offset load on the basis of an unbalance between pressures applied to a front surface and a back surface of the vane existing in the closed section.

In FIG. 14, under a state that a vane 2 received in a groove of a rotor 1 receives a force in a centrifugal direction by a back pressure Pd and a centrifugal force so as to be in contact with an inner periphery of a cam ring 3, and the vane 2 rotates together with a rotation of the rotor 1, in a suction section until one vane 2A reaches an end point of a suction port 4, since the same suction pressure is applied to a front surface and a back surface of the vane 2A, no offset load is applied in a circumferential direction, and the front end of the vane 2A is pressed to the inner periphery of the cam ring 3 due to the back pressure Pd and the centrifugal force and does not move apart from the inner periphery of the cam ring 3. When the vane 2 exists in a first closed section which is not yet connected to a start point of a discharge port 5 after the vane 2 further rotates together with the rotation of the rotor 1 and the vane 2A passes through the suction section, a high pressure in a side of the discharge port 5 and a low pressure in a side of the suction port 4 are respectively applied to the front surface of the vane 2A and the back surface thereof. The offset load is then applied to the vane 2A in a circumferential direction, the vane 2A is inclined in a root portion received within the groove of the rotor 1 so as to be caught thereon. The vane 2A can not be pressed against the inner periphery of the cam ring 3 even by the back pressure Pd and the centrifugal force so as to move apart from the inner periphery of the cam ring 3, whereby the great leakage mentioned above from the discharge port 5 to the suction port 4 is generated with passing through the front end gap of the vane moving apart therefrom. Further, in the second closed section, the same phenomenon is generated.

A detailed description will be given below of problems in the conventional art. In the conventional art, under the maximum eccentric state (during low speed rotation), the inner periphery of the cam ring in the first closed portion and the second closed portion is formed in the concentric circle with the center of rotation of the rotor. Accordingly, since the dynamic radius of the vane in the closed section is constant at a time of the low speed rotation, the moving apart of the vane is not generated (FIGS. 15A and 16A), whereby it is possible to prevent the great pressure pulsation from being generated due to the moving apart. However, under the minimum eccentric state (during high speed rotation), the inner periphery of the cam ring is not the concentric circle with the center of rotation of the rotor together with the first closed portion and the second closed portion, and when the vane is caught on due to the offset load on the basis of the unbalance of pressure between the front surface and the back surface, the front end of the vane moves apart from the inner surface of the cam ring and the great pressure pulsation is generated.

That is, FIGS. 15A and 15B show a motion of the vane front end in the first closed portion by setting an angle of rotation of the rotor to a horizontal axis and setting a dynamic radius corresponding to a protruding radius of the vane with respect to the center of rotation of the rotor to a vertical axis, in which a solid line relates to the cam ring corresponding to the concentric circle with the center of rotation of the rotor, and a broken line relates to the cam ring formed in a completed round shape. In this case, since the distance between the rotor and the cam ring is constant as expressed by a relation Ha=Hb=Hc in FIG. 17A during low speed rotation in the first closed portion in FIG. 15A, the moving apart of the vane is hard to be generated. Since the cam ring becomes in the minimum eccentric state and the distance between the rotor and the cam ring becomes short in a center (Hb) of the first closed portion and becomes long in both sides (Ha, Hc) thereof as shown in FIG. 17B, at a time of the high speed rotation in the first closed portion in FIG. 15B, the vane is pressed in a centripetal direction in the front half of the first closed portion so as not to move apart. In a rear half, since the dynamic radius becomes a positive incline (a positive slope), the eccentric load is applied to the vane and the vane is caught on, so that the vane moves apart.

FIGS. 16A and 16B show a motion of the vane front end in the second closed portion by setting an angle of rotation of the rotor to a horizontal axis and setting a dynamic radius corresponding to a protruding radius of the vane with respect to the center of rotation of the rotor to a vertical axis, in which a solid line relates to the cam ring corresponding to the concentric circle with the center of rotation of the rotor, and a broken line relates to the cam ring formed in a completed round shape. In this case, since the distance between the rotor and the cam ring is constant as expressed by a relation Hd=He=Hf in FIG. 17A during the low speed rotation in the first closed portion in FIG. 16A, it is hard to generate the moving apart of the vane. However, when the cam ring becomes the minimum eccentric state during high speed rotation, the distance between the rotor and the cam ring becomes long in a center (He) of the second closed portion and short in both sides (Hd, Hf) thereof as shown in FIG. 17B, so that the vane generates the moving apart in a front half of the second closed portion.

SUMMARY OF THE INVENTION

An object of the present invention is to prevent a vane from generating a moving apart around a wide range of a pump rotational speed, in other words, around a wide eccentric area of a cam ring, in a variable capacity type vane pump so as to reduce a pressure pulsation and a vibration and a sound generated together therewith.

The present invention relates to a variable capacity type pump comprised of a pump casing with a complete round rotor arranged therein so as to be rotated, and a cam ring set in the periphery of the rotor, forming a pump chamber with respect to an outer peripheral portion of the rotor and capable of being eccentric with respect to the rotor. A suction port is arranged in the pump casing and sucks a working fluid to the pump chamber, and a discharge port arranged in the pump casing and discharges the working fluid from the pump chamber. A plurality of vanes received in a groove of the rotor, protruding so as to freely move in a radial direction and in contact with an inner periphery of the cam ring at front ends and the working fluid sucked from the suction port is held in a space between the adjacent vanes. The working fluid is transferred due to a rotation of the rotor so as to be discharged from the discharge port. The amount discharge of the working fluid is increased by increasing an eccentric amount of the cam ring with respect to the rotor. The inner periphery of the cam ring is constituted by a shape of a suction section sucking the working fluid from the suction port, a shape of a first closed section at a bottom dead center transferring the working fluid sucked from the suction port to the discharge port after previously compressing, a shape of a discharge section discharging the working fluid from the discharge port, and a shape of a second closed section transferring the working fluid held in the space between the adjacent vanes at a top dead to the suction port.

The inner periphery of the cam ring in the suction section and the discharge section is constituted by a complete round curve and a transient curve. The inner periphery of the cam ring in the closed section is constituted by a negative slope curve in which a radius of curvature reduces along the rotational direction of the rotor so as to always reduce a dynamic radius of the vane with respect to an increase of the rotational angle of the rotor without relation to the eccentric amount of the cam ring.

The present invention relate to a variable capacity type pump comprised of a pump casing with a complete round rotor arranged therein so as to be rotated and a cam ring set in the periphery of the rotor, forming a pump chamber with respect to an outer peripheral portion of the rotor and capable of being eccentric with respect to the rotor. A suction port is arranged in the pump casing and sucks a working fluid to the pump chamber and a discharge port arranged in the pump casing and discharging the working fluid from the pump chamber. A plurality of vanes received in a groove of the rotor, protruding so as to freely move in a radial direction and in contact with an inner periphery of the cam ring at front ends and the working fluid sucked from the suction port is held in a space between the adjacent vanes, the working fluid being transferred due to a rotation of the rotor so as to be discharged from the discharge port. The amount of discharge of the working fluid is increased by increasing an eccentric amount of the cam ring with respect to the rotor. The inner periphery of the cam ring is constituted by a shape of a suction section sucking the working fluid from the suction port, a shape of a first closed section at a bottom dead center transferring the working fluid sucked from the suction port to the discharge port after previously compressing, a shape of a discharge section discharging the working fluid from the discharge port, and a shape of a second closed section transferring the working fluid held in the space between the adjacent vanes at a top dead to the suction port.

The inner periphery of the cam ring in the suction section and the discharge section is constituted by a complete round curve and a transient curve. The inner periphery of the cam ring in the closed section is constituted by a plurality of negative slope curves in which a radius of curvature reduces along the rotational direction of the rotor so as to always reduce a dynamic radius of the vane with respect to an increase of the rotational angle of the rotor without relation to the eccentric amount of the cam ring.

BRIEF DESCRIPTION OF THE DRAWINGS

The present invention will be more fully understood from the detailed description given below and from the accompanying drawings which should not be taken to be a limitation on the invention, but are for explanation and understanding only.

DESCRIPTION OF THE PREFERRED EMBODIMENTS

Figure 1:
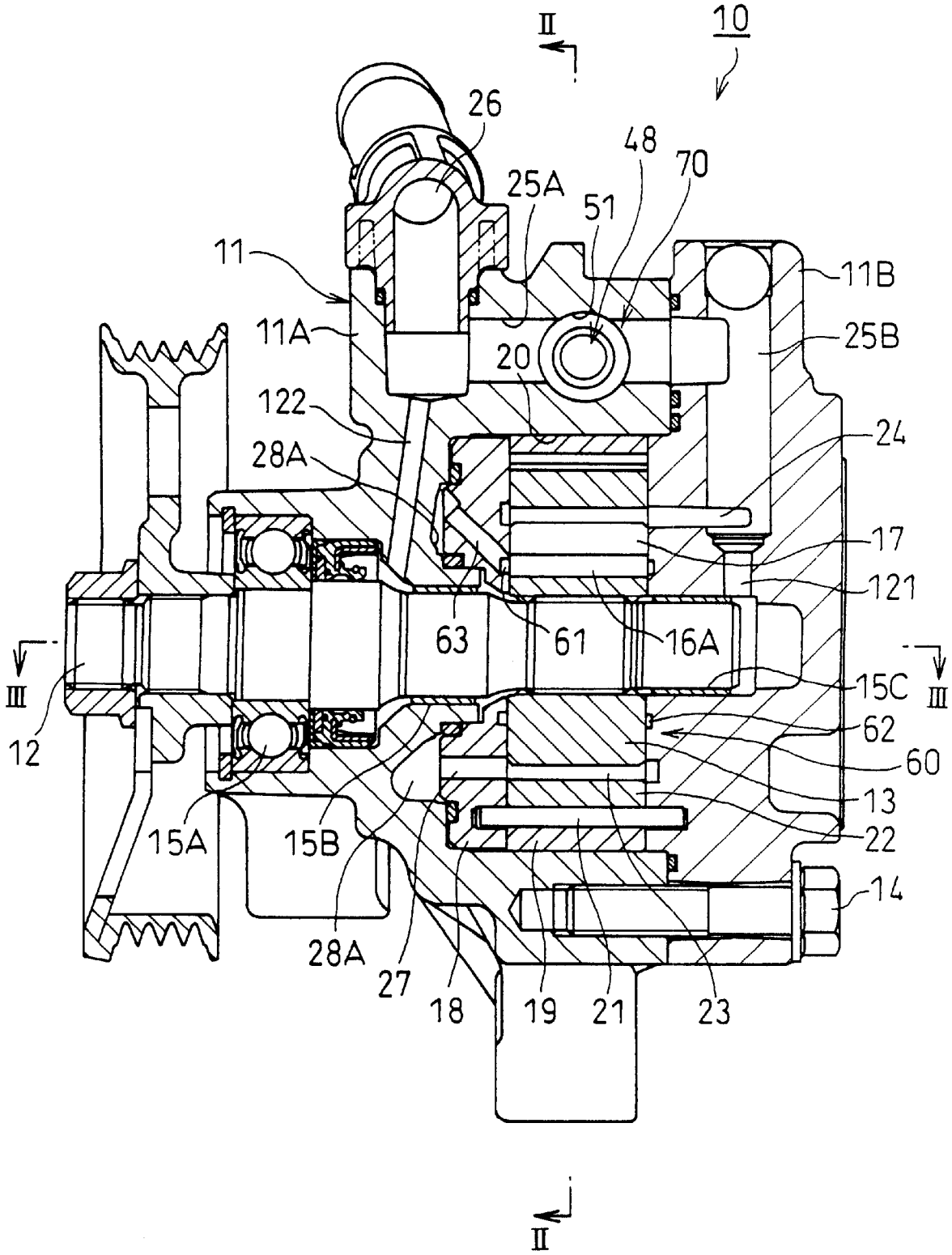
FIG. 1 is a cross sectional view showing a variable capacity type pump.
Figure 2:
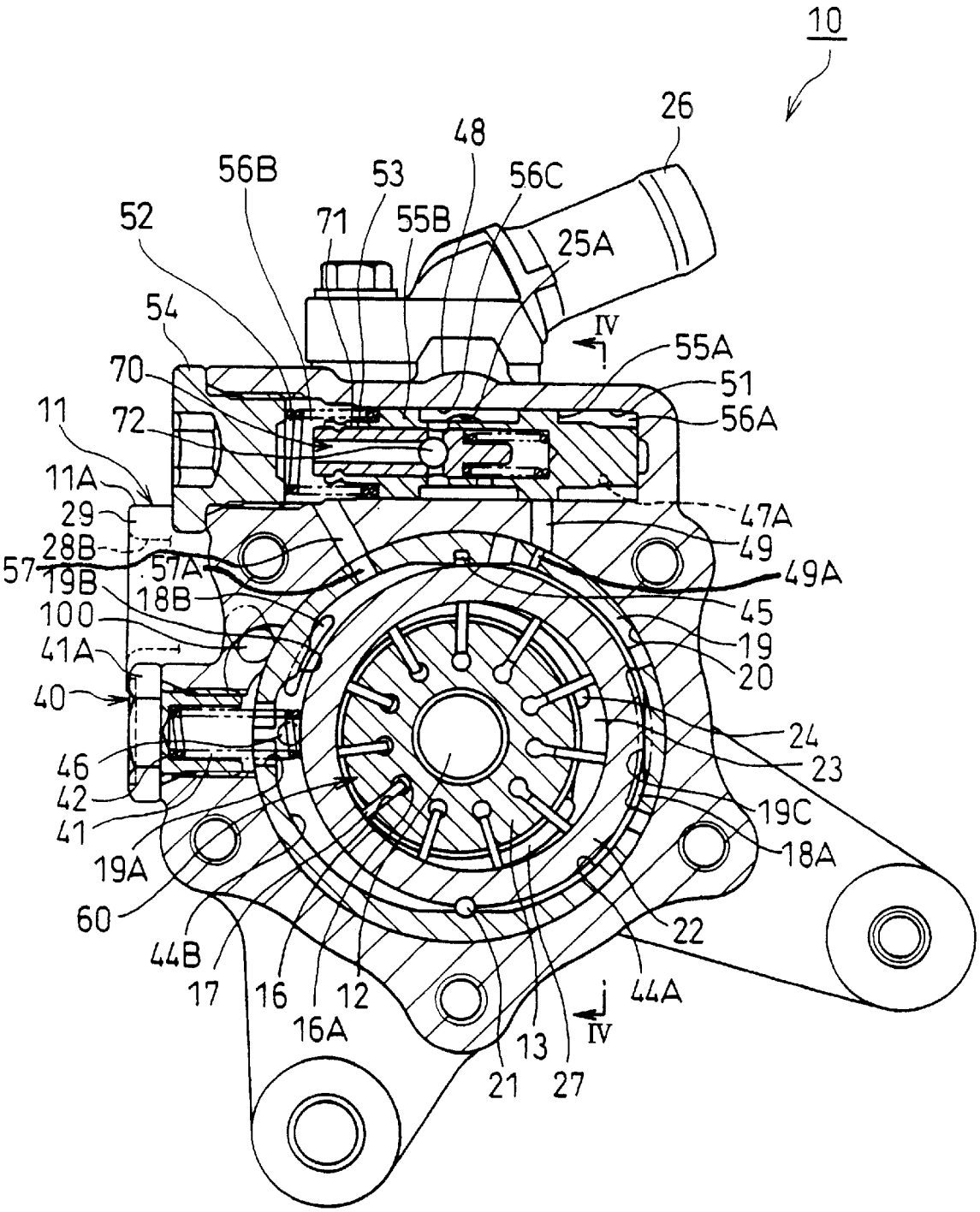
FIG. 2 is a cross sectional view along a line II—II in FIG. 1.
Figure 3:
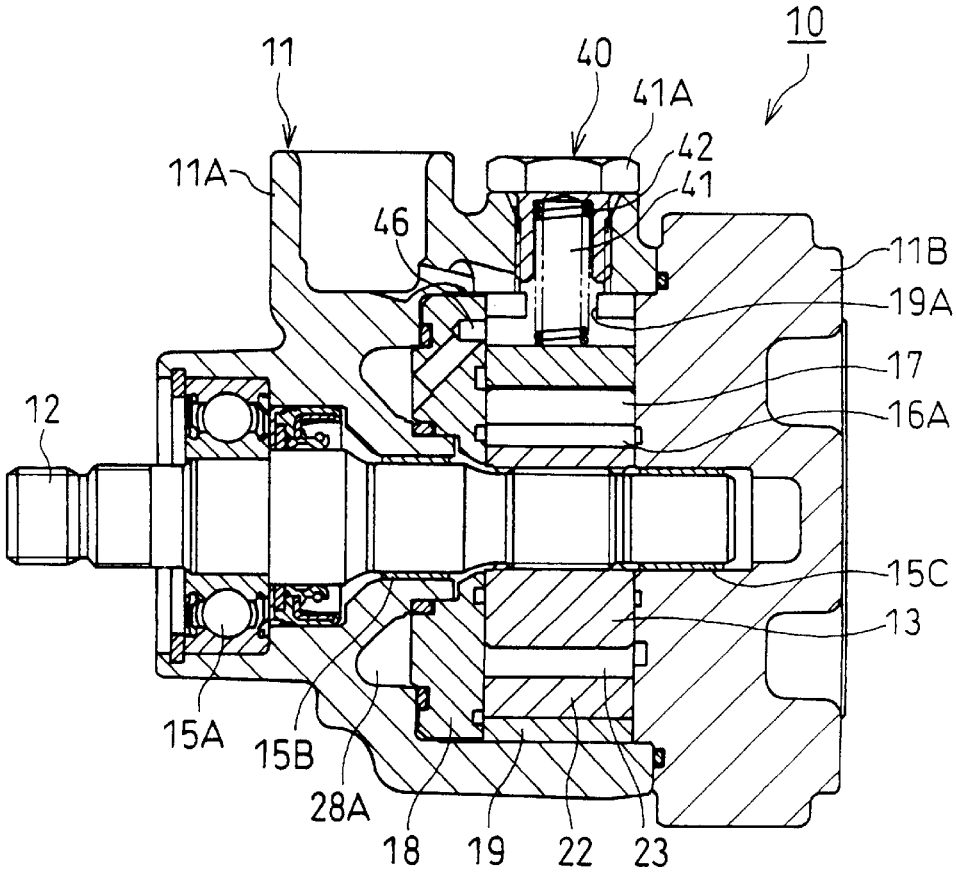
FIG. 3 is a cross sectional view along a line III—III in FIG. 1.

A variable capacity type pump 10 is a vane pump corresponding to an oil pressure generating source of a hydraulic power steering apparatus for a motor vehicle, and has a rotor 13 fixed according to a serration to a pump shaft 12 inserted to a pump casing 11 so as to be rotated and driven as shown in FIG. 1 to FIG. 3. The pump casing 11 is structured by integrally combining a pump housing 11A with a cover 11B by using a bolt 14, and supports the pump shaft 12 via bearings 15A to 15C. The pump shaft 12 can be directly rotated and driven by an engine of a motor vehicle.

The rotor 13 receives vanes 17 in grooves 16 respectively provided at a multiple positions in a peripheral direction and protrudes so as to freely move the respective vanes 17 in a radial direction along the grooves 16.

A pressure plate 18 and an adapter ring 19 are fitted to a fitting hole 20 in the pump housing 11A of the pump casing 11 in a laminated state, and these elements are fixed and held from a side portion by the cover 11B in a state of being positioned in a peripheral direction by a supporting point pin 21 mentioned below. One end of the supporting point pin 21 is fitted and fixed to the cover 11B.

A cam ring 22 is fitted to the adapter ring 19 mentioned above fitted to the pump housing 11A of the pump casing 11. The cam ring 22 surrounds the rotor 13 with an eccentricity with respect to the rotor 13, and forms a pump chamber 23 between the cam ring 22 and an outer peripheral portion of the rotor 13, between the pressure plate 18 and the cover 11B. Further, a suction area in an upstream side in a rotor rotational direction of the pump chamber 23, a suction port 24 provided in the cover 11B is opened, and a suction port 26 of the pump 10 is communicated with the suction port 24 via suction passages 25A and 25B provided in the housing 11A and the cover 11B. On the contrary, a discharge port 27 provided in the pressure plate 18 is opened to a discharge area in a downstream side in the rotor rotational direction of the pump chamber 23, and a discharge port 29 of the pump 10 is communicated with the discharge port 27 via a high pressure chamber 28A and a discharge passage 28B provided in the housing 11A.

In the variable capacity type pump 10, when the rotor 13 is rotated and driven by the pump shaft 12 and the vane 17 of the rotor 13 is pressed to the cam ring 22 due to a centrifugal force and a back pressure so as to rotate, in a suction section in the upstream side in the rotor rotational direction of the pump chamber 23, the variable capacity type pump 10 expands a capacity surrounded by the adjacent vanes 17 and the cam ring 22 together with the rotation so as to suck a working fluid from the suction port 24, and transfer the working fluid on the basis of the rotation of the rotor 13 with holding the working fluid between the adjacent vanes 17, and in a discharge section in the downstream side in the rotor rotational direction of the pump chamber 23, the variable capacity type pump 10 reduces the capacity surrounded by the adjacent vanes 17 and the cam ring 22 together with the rotation so as to discharge the working fluid from the discharge port 27.

Accordingly, the variable capacity type pump 10 has a discharge flow amount control apparatus 40 structured in the following manner (A) and a vane pressurizing apparatus 60 structured in the following manner (B).

(A) Discharge Flow Amount Control Apparatus 40

The discharge flow amount control apparatus 40 is structured such that the supporting point pin 21 is mounted on a vertical lowermost portion of the adapter ring 19 fixed to the pump casing 11. The vertical lowermost portion of the cam ring 22 is supported to the supporting point pin 21, and the cam ring 22 can be swingably displaced within the adapter ring 19.

The discharge flow amount control apparatus 40 can apply an urging force making the capacity of the pump chamber 23 maximum to the cam ring 22 by passing a spring 42 received in a spring chamber 41 provided in the pump housing 11A constituting the pump casing 11 through a spring hole 19A provided in the adapter ring 19 so as to be in pressure contact with an outer peripheral portion of the cam ring 22.

The spring 42 is backed up by a cap 41A attached to an opening portion of the spring chamber 41. In this case, the adapter ring 19 is structured such that a cam ring movement restricting stopper 19B is formed in a protruding shape in a part of an inner peripheral portion forming a second fluid pressure chamber 44B mentioned below, whereby it is possible to restrict a moving limit (a minimum eccentric position) of the cam ring 22 for making the capacity of the pump chamber 23 minimum as mentioned below. Further, the adapter ring 19 is structured such that a cam ring movement restricting stopper 19C is formed in a protruding shape in a part of an inner peripheral portion forming a first fluid pressure chamber 44A mentioned below so as to restrict a moving limit (a maximum eccentric position) of the cam ring 22 for making the capacity of the pump chamber 23 maximum as mentioned below.

The discharge flow amount control apparatus 40 separately forms the first and second fluid pressure chambers 44A and 44B between the cam ring 22 and the adapter ring 19. The first fluid pressure chamber 44A and the second fluid pressure chamber 44B are separated between the cam ring 22 and the adapter 19 by the supporting point pin 21 and a seal member 45 provided at an axially symmetrical position. At this time, the first and second fluid pressure chambers 44A and 44B are sectioned both side portions between the cam ring 22 and the adapter ring 19 by the cover 11B and the pressure plate 18. They are provided with a communicating groove 18A communicating the first fluid pressure chambers 44A separated into both sides of the stopper 19C with each other and a communicating groove 18B communicating the second fluid pressure chambers 44B separated into both sides of the stopper 19B with each other, when the cam ring 22 is collided and aligned with the cam ring movement restricting stoppers 19B and 19C mentioned above in the adapter ring 19, in the pressure plate 18.

In the discharge path of the pump 10 the pressure fluid discharged from the pump chamber 23 and fed out to the high pressure chamber 28A of the pump housing 11A from the discharge port 27 of the pressure plate 18 is fed to the discharge passage 28B from a metering orifice 46 pieced in the pressure plate 18 via the second fluid pressure chamber 44B, the spring chamber 41 mentioned above passing through the adapter ring 19 and a discharge communicating hole 100 notched in the fitting hole 20 of the pump housing 11A.

Figure 4:
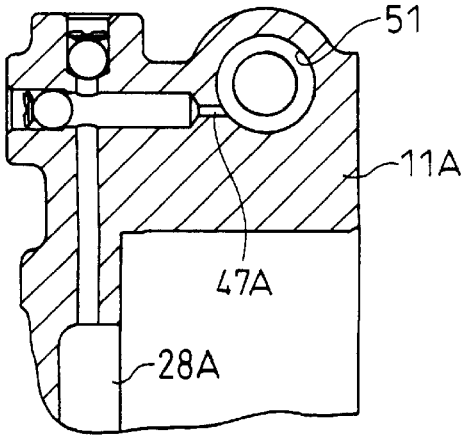
FIG. 4 is a cross sectional view along a line IV—IV in FIG. 2.

The discharge flow amount control apparatus 40 increases and reduces an opening area of the metering orifice 46 open to the second fluid pressure chamber 44B by the side wall of the cam ring 22, in the discharge path of the pump 10 thereby forming a variable metering orifice. That is, an opening degree of the orifice 46 is adjusted by the side wall in correspondence to the moving displacement of the cam ring 22. Then, the discharge flow amount control apparatus 40 introduces the high fluid pressure of the high pressure chamber 28A before passing through the orifice 46 to the first fluid pressure chamber 44A via a first fluid pressure supply passage 47A (FIG. 4), a switch valve apparatus 48, the pump housing 11A and a communicating passage 49 pierced in the adapter 19. And the discharge flow amount control apparatus 40 introduces the reduced pressure after passing through the orifice 46 to the second fluid pressure chamber 44B in the manner mentioned above, moves the cam ring 22 against the urging force of the spring 42 due to a differential pressure of the pressure applied to both of the fluid pressure chambers 44A and 44B, and changes the capacity of the pump chamber 23, thereby capable of controlling the discharge flow amount of the pump 10.

The switch valve apparatus 48 is structured such that a spring 52 and a switch valve 53 are received in a valve receiving hole 51 pierced in the pump housing 11A, and the switch valve 53 urged by the spring 52 is supported by a cap 54 engaged with the pump housing 11A. The switch valve 53 is provided with a switch valve body 55A and a valve body 55B, and is structured such that the first fluid pressure supply passage 47A is communicated with a pressurizing chamber 56A provided in one end side of the switch valve body 55A, and the second fluid pressure chamber 44B is communicated with a back pressure chamber 56B in which a spring 52 provided in another end side of the valve body 55B is stored, via the pump housing 11A and a communicating passage 57 pieced in the adapter ring 19. Further, a suction passage (a drain passage) 25A is formed in a through manner in a middle chamber 56C between the switch valve body 55A and the valve body 55B, and is communicated with a tank. The switch valve body 55A can open and close the pump housing 11A and the communicating passage 49 pierced in the adapter ring 19. That is, in a low speed rotational range having a low discharge pressure of the pump 10, the switch valve body 55A sets the switch valve 53 to an original position shown in FIG. 2 due to the urging force of the spring 52 and closes the communicating passage 49 with the first fluid pressure chamber 44A by the switch valve body 55A. And in a middle and high speed rotational range of the pump 10, the switch valve body 55A moves the switch valve 53 due to the high pressure fluid applied to the pressurizing chamber 56A so as to open the communicating passage 49, thereby introducing the high pressure fluid to the first fluid pressure chamber 44A.

A discharge flow amount characteristic of the pump 10 provided with the discharge flow amount control apparatus 40 is as follows.

(1) In a low speed running range of a motor vehicle in which the rotational speed of the pump 10 is low, the pressure of the fluid discharged from the pump chamber 23 to the pressurizing chamber 56A of the switch valve apparatus 48 is yet low, the switch valve 53 is positioned at the original position and the cam ring 22 maintains the original state (a maximum eccentric position) urged by the spring 42. Accordingly, the discharge flow amount of the pump 10 is increased in proportion to the rotational speed.

(2) When the pressure of the fluid discharged from the pump chamber 23 to the pressurizing chamber 56A of the switch valve apparatus 48 becomes high due to an increase of the rotational speed of the pump 10, the switch valve apparatus 48 moves the switch valve 53 against the urging force of the spring 52 so as to open the communicating passage 49 and introduces the high pressure fluid to the first fluid pressure chamber 44A. Accordingly, the cam ring 22 moves due to the differential pressure of the pressure applied to the first fluid pressure chamber 44A and the second fluid pressure chamber 44B so as to gradually reduce the capacity of the pump chamber 23. Accordingly, the discharge flow amount of the pump 10 can cancel the flow amount increase caused by the increase of the rotational speed and the flow amount reduction caused by the reduction of the capacity in the pump chamber 23 with respect to the increase of the rotational speed, so as to maintain a fixed large flow amount.

(3) When the rotational speed of the pump 10 is continuously increased more and the cam ring 22 is further moved, whereby the cam ring 22 presses the spring 42 over a fixed amount, the side wall of the cam ring 22 starts throttling an open area of the orifice 46 in the middle portion of the discharge path from the pump chamber 23. Accordingly, the discharge flow amount pressure fed to the discharge passage 28B of the pump 10 is reduced in proportion to the throttling amount of the orifice 46.

(4) When reaching a high speed drive range of the motor vehicle in which the rotational speed of the pump 10 is over a fixed value, the cam ring 22 reaches a moving limit (a minimum eccentric position) where the cam ring 22 is collided and aligned with the stopper 19B of the adapter ring 19, the throttling amount of the orifice 46 generated by the side wall of the cam ring 22 becomes maximum, and the discharge flow amount of the pump 10 maintains a fixed small flow amount.

In the discharge flow amount control apparatus 40, the throttle 49A is provided in the communicating passage 49 communicating the pressurizing chamber 56A of the switch valve apparatus 48 with the first fluid pressure chamber 44A, and the throttle 57A is provided in the communicating passage 57 communicating the second fluid pressure chamber 44B with the back pressure chamber 56B of the switch valve apparatus 48.

(B) Vane Pressurizing Apparatus 60

Figure 14:
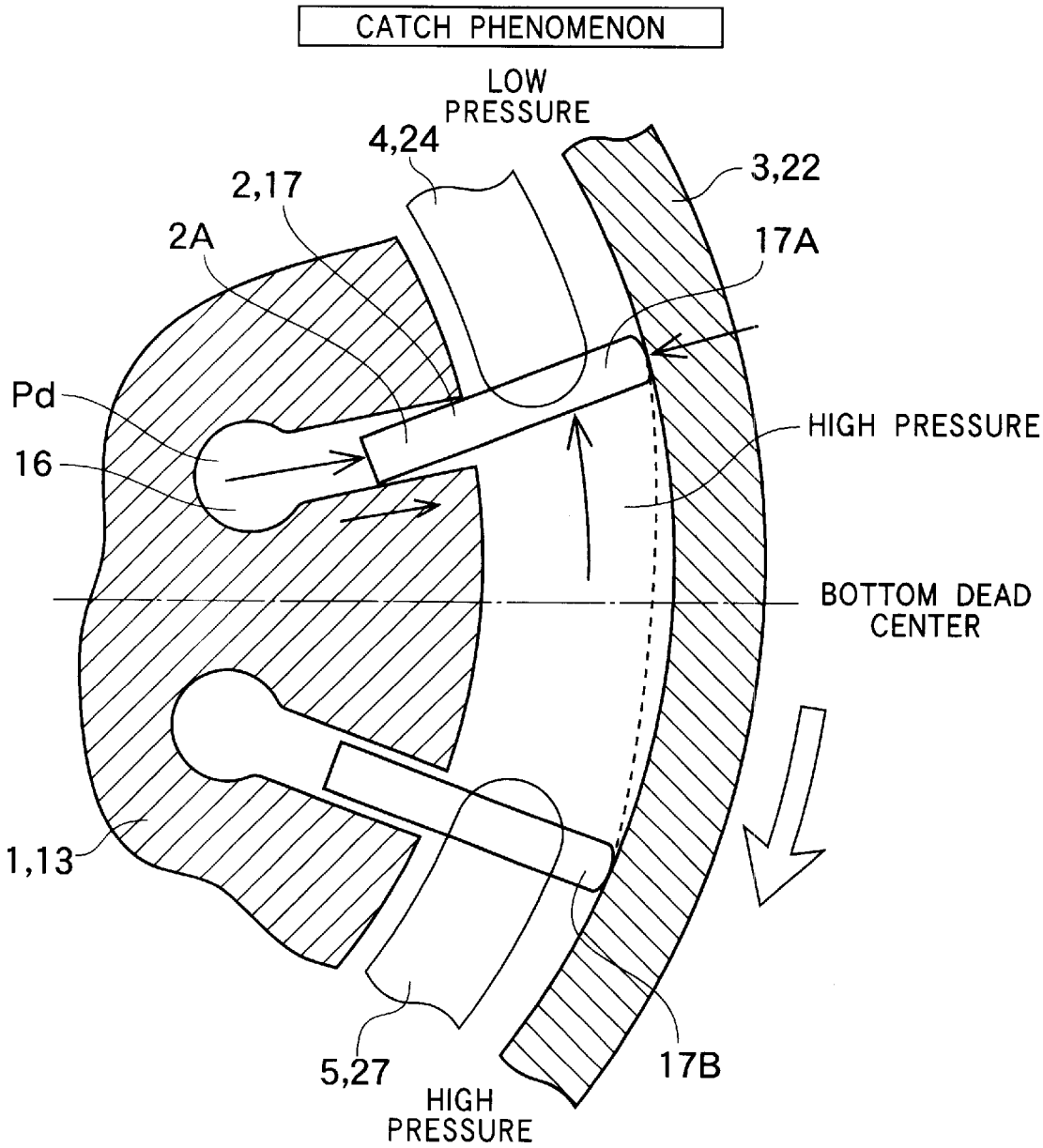
FIG. 14 is a schematic view showing a catch phenomenon of the vane in the first closed section.
Figure 15A:
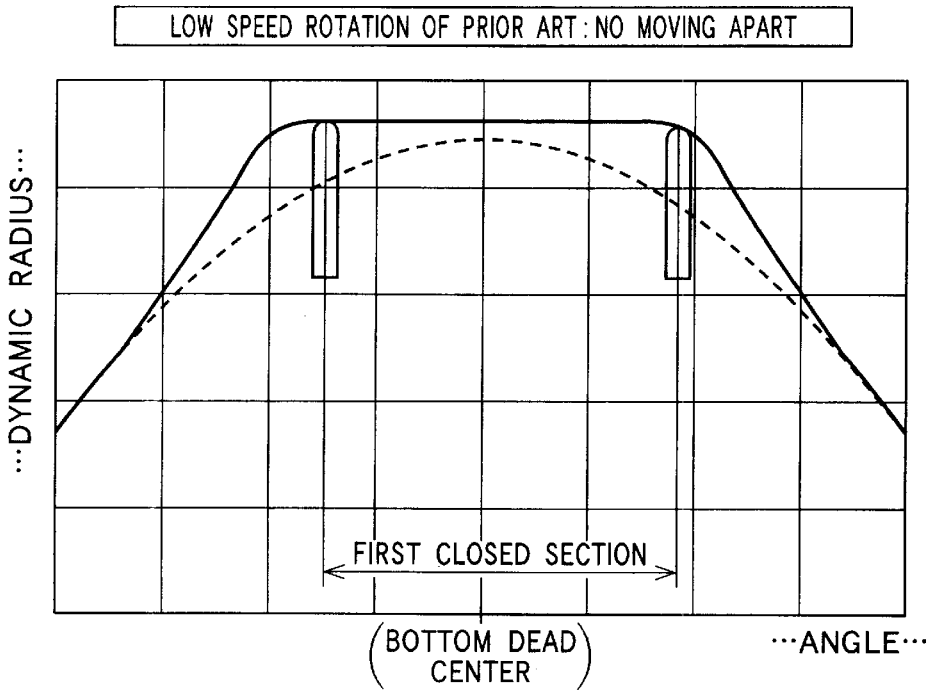
FIG.15A (PRIOR ART)
FIGS. 15A and 15B are graphs showing a vane moving apart state at a time of a low speed rotation and at a time of a high speed rotation in a first closed section of a conventional cam ring.
Figure 15B:
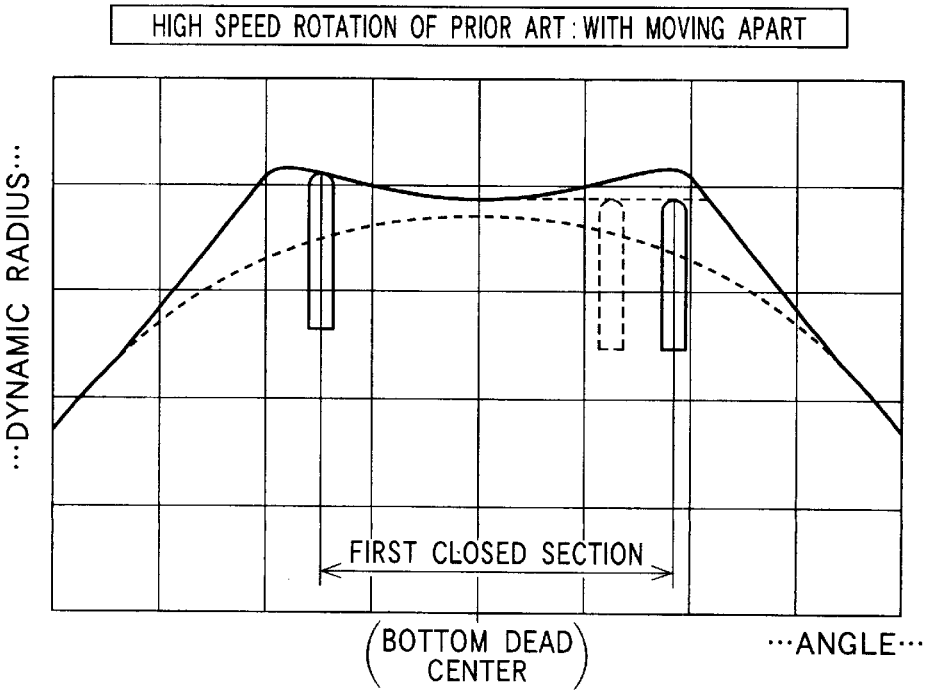
FIG.15B (PRIOR ART)
Figure 16A:
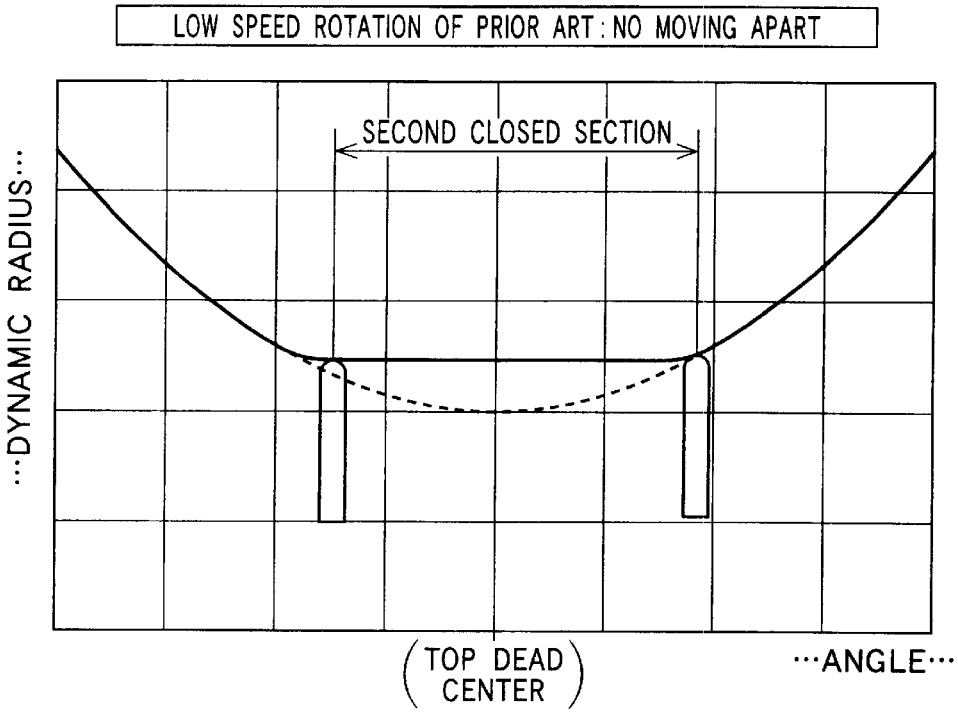
FIG.16A (PRIOR ART)
FIGS. 16A and 16B are graphs showing a vane moving apart state at a time of a low speed rotation and at a time of a high speed rotation in a second closed section of a conventional cam ring.
Figure 16B:
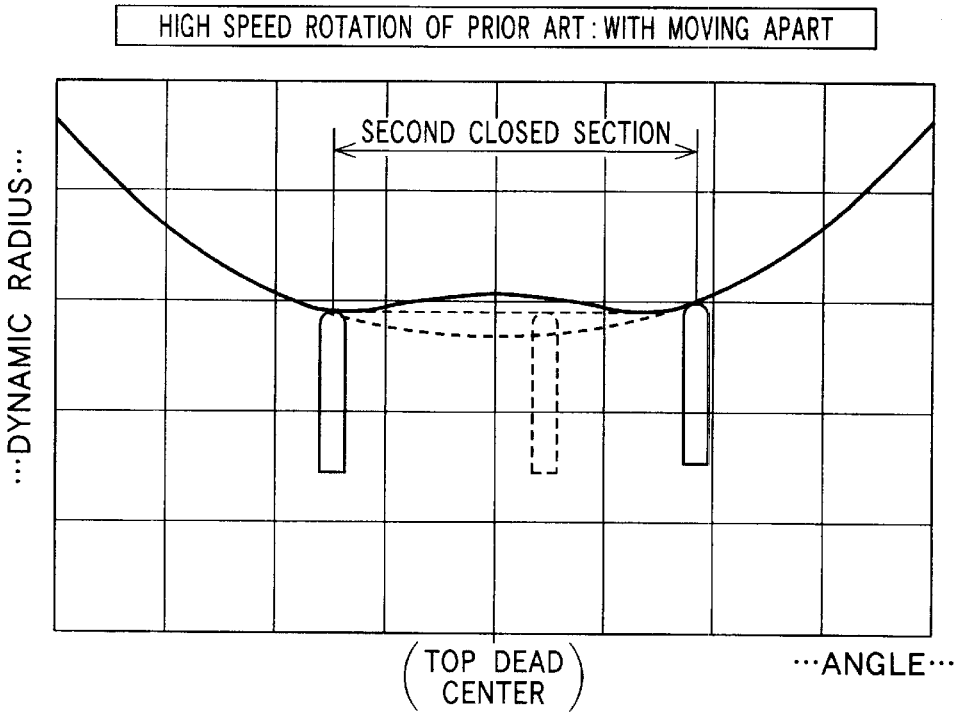
FIG.16B (PRIOR ART)
Figure 17A:
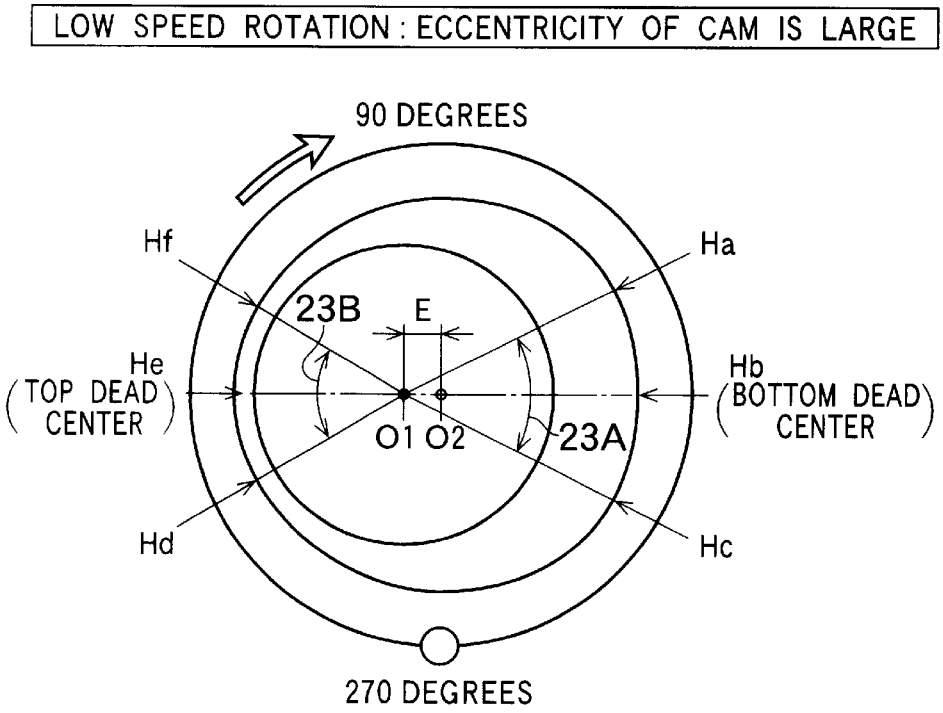
FIGS. 17A and 17B are schematic views showing an eccentric state of the cam ring at a time of a low speed rotation and at a time of a high speed rotation.
Figure 17B:
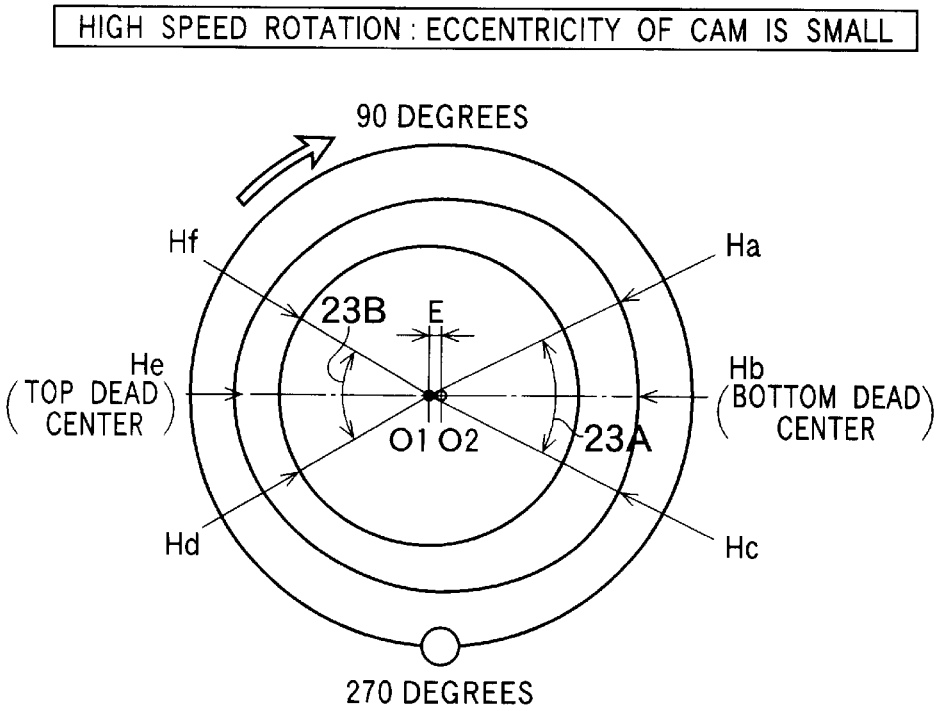

The vane pressurizing apparatus 60 is provided with ring-shaped oil grooves 61 and 62 on slidable contact surfaces of the pressure plate 18 and the side plate 20 with the grooves 16, corresponding to both sides of the base portion 16A of the grooves 16 receiving the vane 17 of the rotor 13. Then, the high pressure chamber 28A of the pump chamber 23 provided in the pump housing 11A is communicated with the oil groove 61 mentioned above via an oil hole 63 provided in the pressure plate 18. Accordingly, the pressure fluid discharged from the pump chamber 23 to the high pressure chamber 28A can be introduced to the base portion of the grooves 16 for all the vanes 17 in the peripheral direction of the rotor 13 via the oil grooves 61 and 62 of the pressure plate 18 and the side plate 20 so as to generate a back pressure Pd against the vane 17 (FIG. 14), and can pressurize each of the vanes 17 toward the cam ring 22.

Accordingly, the pump 10 presses the vane 17 to the cam ring 22 due to a centrifugal force at a start time of rotation, however, after the discharge pressure is generated, the pump 10 increases the contact pressure between the vane 17 and the cam ring 22 due to the back pressure Pd applied by the vane pressurizing apparatus 60, thereby capable of preventing the pressure fluid from inversely flowing.

The pump 10 has a relief valve 70 relieving the excessive fluid pressure in the pump discharge side between the high pressure chamber 28A and the suction passage (the drain passage) 25A so as to be installed in the switch valve 53. The relief valve 70 is structured such as to be a direct drive type installed in a main valve 71 constituted by the switch valve 53 itself. Further, in the pump 10, a lubricating oil supply passage 121 from the suction passage 25B toward the bearing 15C of the pump shaft 12 is pierced in the cover 11B, and a lubricating oil return passage 122 returning from a peripheral portion of the bearing 15B of the pump shaft 12 to the suction passage 25A is pieced in the pump housing 11A.

In the pump 10, within the pump chamber 23, in a first closed section 23A in which the working fluid sucked from the suction port 24 is discharged and previously compressed so as to be moved to the discharge port 27 between the suction section sucking the working fluid from the suction port 24 and the discharge section discharging the working fluid from the discharge port 27, and the second closed section 23B closing the discharge section and the suction section, the following structure for preventing the vane from moving apart all around a wide rotational speed range and reducing the pressure pulsation is provided.

(First Embodiment) (FIGS. 5 to 8)

Figure 5:
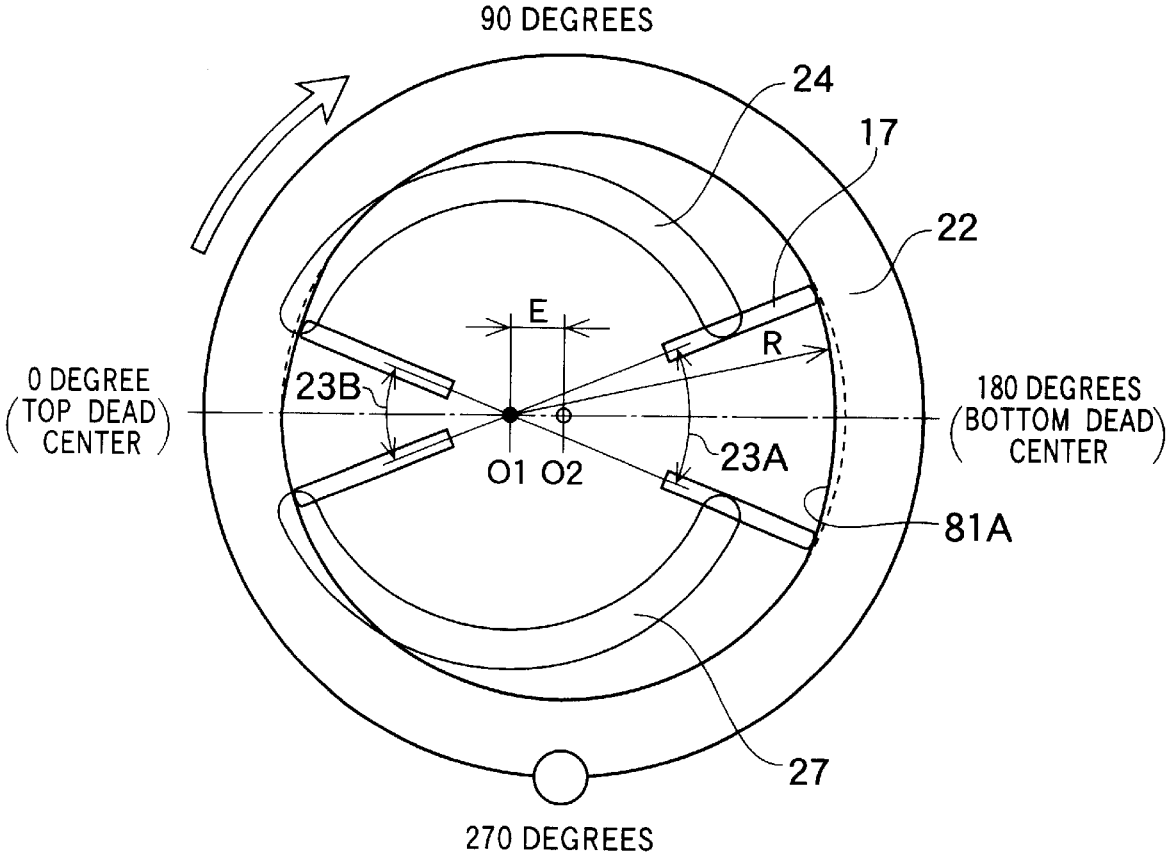
FIG. 5 is a schematic view showing a cam ring.

The inner peripheral shape of the cam ring 22 is set as described in the following items (1) to (5). In FIG. 5, the cam ring 22 is in the maximum eccentric state, and reference symbol O1 denotes a center position of the rotor 13, reference symbol O2 denotes a center position of an inner peripheral complete round portion of the ring 22, and reference symbol E denotes an amount of maximum eccentricity of the ring 22.

(1) In the rotational direction of the rotor 13 under the maximum eccentric state of the cam ring 22, in the suction section in a range that the vane is positioned at the suction port 24 and the discharge section in a range that the vane is positioned at the discharge port 27, the inner peripheral shape of the cam ring 22 is constituted by the complete round curves H to A and D to E (the center O2).

(2) In the first closed section 23A held between the suction section and the discharge section and in which the space between the adjacent vanes 17 and 17 is connected neither to the suction port 24 nor to the discharge port 27, the inner peripheral shape of the cam ring 22 is constituted by a curve (radius of curvature reducing curves on which the radius of curvature reduces along the rotational direction of the rotor 13) (hereinafter, refer to a negative slope curve) B to C capable of applying a centripetal motion that a protruding radius (a dynamic radius) of the vane 17 with respect to the center O1 of the rotor 13 progressively reduces together with an increase of the rotational angle of the rotor 13, in such a manner as to be always in contact with the front end of the vane 17 without relation to an amount of eccentricity E 20 and freely press the vane 17 in the centripetal direction entering along the groove 16 of the rotor 13.

(3) In a connecting portion in which the suction section or the discharge section is connected to the first closed section 23A, the inner peripheral shape of the cam ring 22 is constituted by second or more high-order curves A to B and C to D (transient curves) smoothly connecting a negative slope curve B to C in the first closed section 23A to a complete round curve D to E or H to A in the suction section or the discharge section.

(4) In the second closed section 23B held between the suction section and the discharge section and in which the space between the adjacent vanes 17 and 17 is connected neither to the suction port 24 nor to the discharge port 27, the inner peripheral shape of the cam ring 22 is constituted by a negative slope curve (radius of curvature reducing curves on which the radius of curvature reduces along the rotational direction of the rotor 13) F to G capable of applying a centripetal motion that a dynamic radius of the vane 17 with respect to the center O1 of the rotor 13 progressively reduces together with an increase of the rotational angle of the rotor 13, in such a manner as to be always in contact with the front end of the vane 17 without relation to an amount of eccentricity E and freely press the vane 17 in the centripetal direction entering along the groove 16 of the rotor 13.

(5) In a connecting portion in which the suction section or the discharge section is connected to the second closed section 23B, the inner peripheral shape of the cam ring 22 is constituted by second or more high-order curves E to F and G to H (transient curves) smoothly connecting a negative slope curve F to G in the second closed section 23B to the complete round curve D to E or H to A in the suction section or the discharge section.

Figure 6:
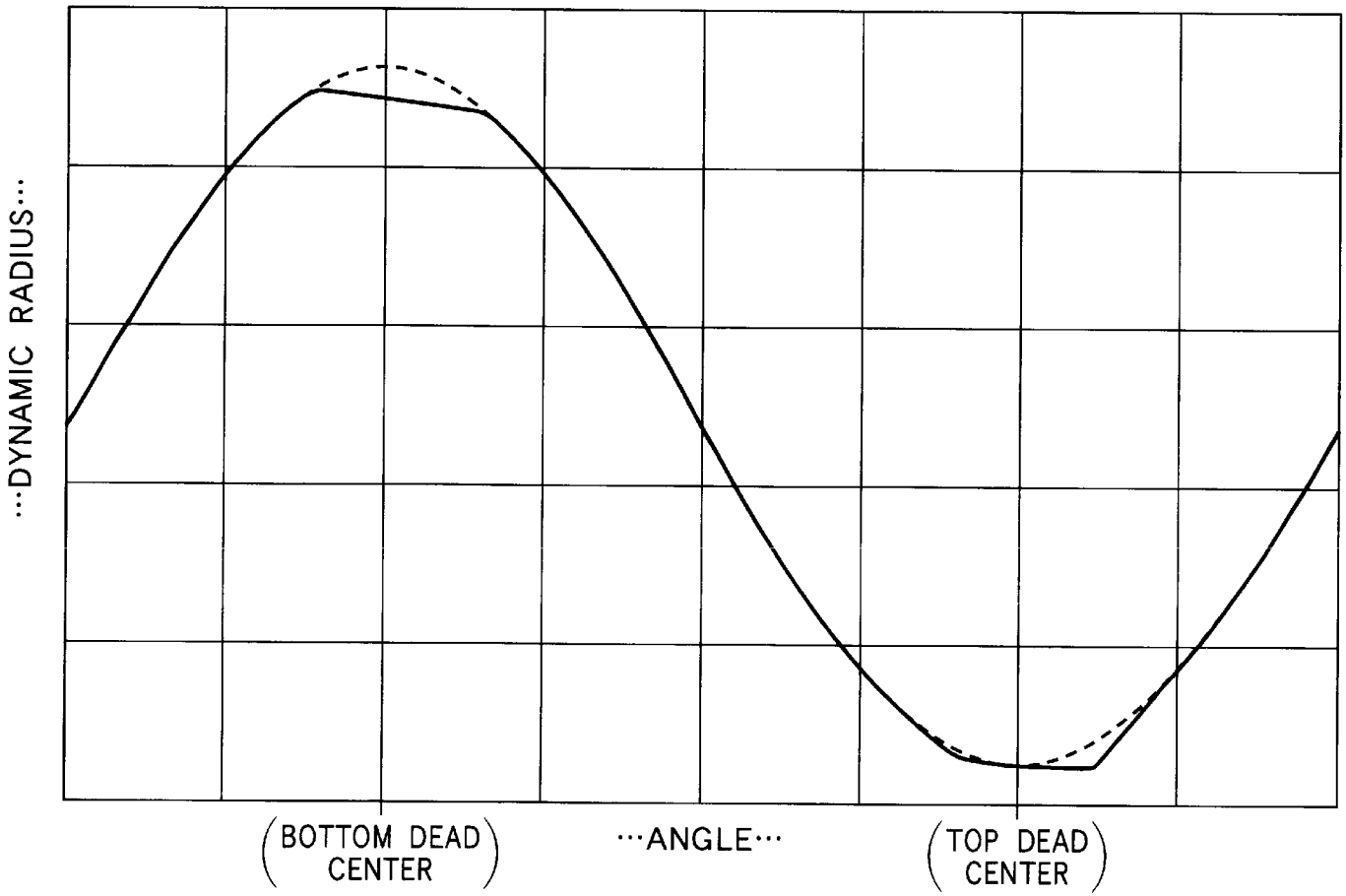
FIG. 6 is a graph showing a change of a radius (a dynamic radius) of a vane extending all the periphery of a cam ring according to a first embodiment.
Figure 7:
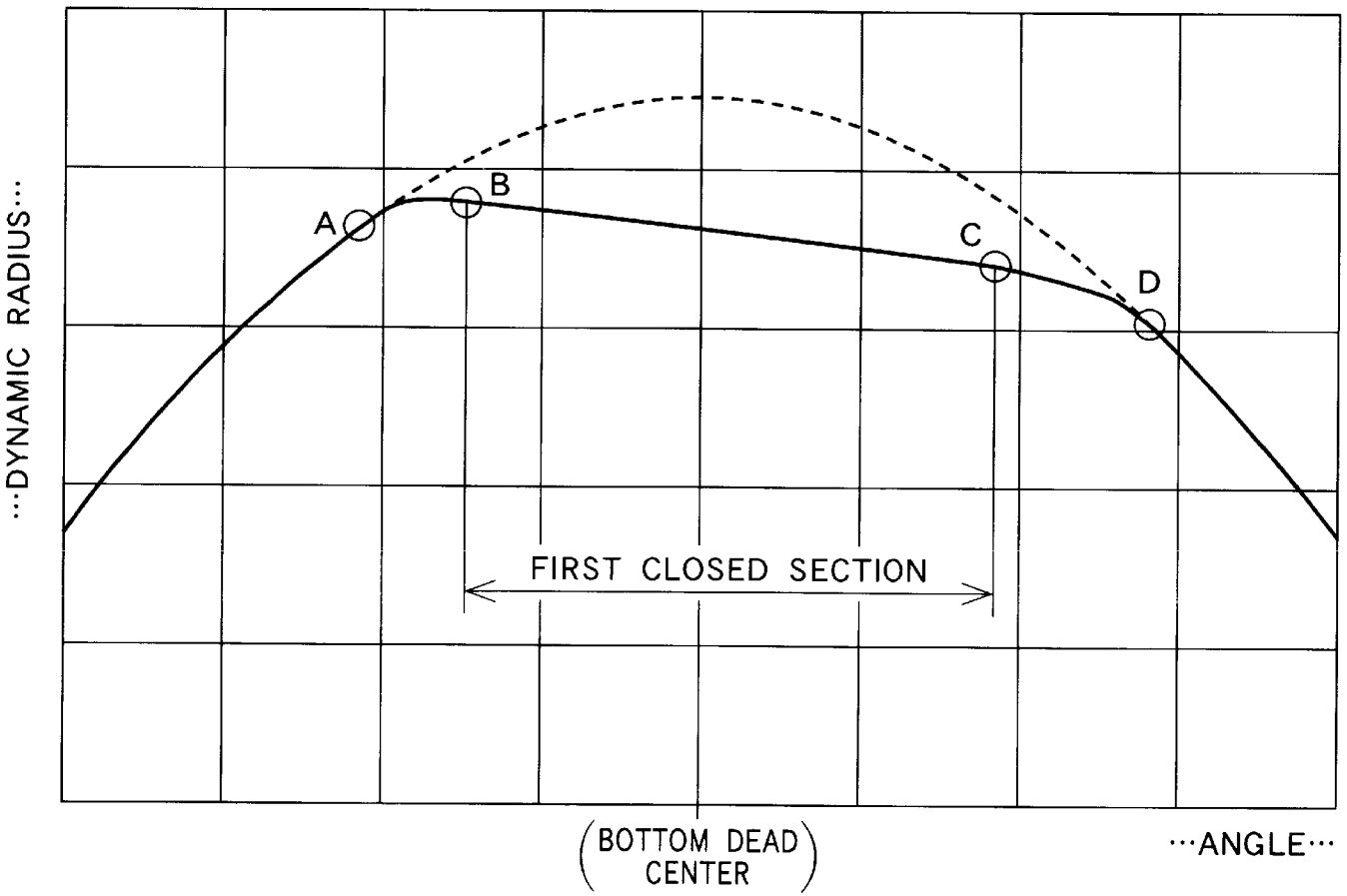
FIG. 7 is an expanded graph of a first closed section in the dynamic radius according to the first embodiment.
Figure 8:
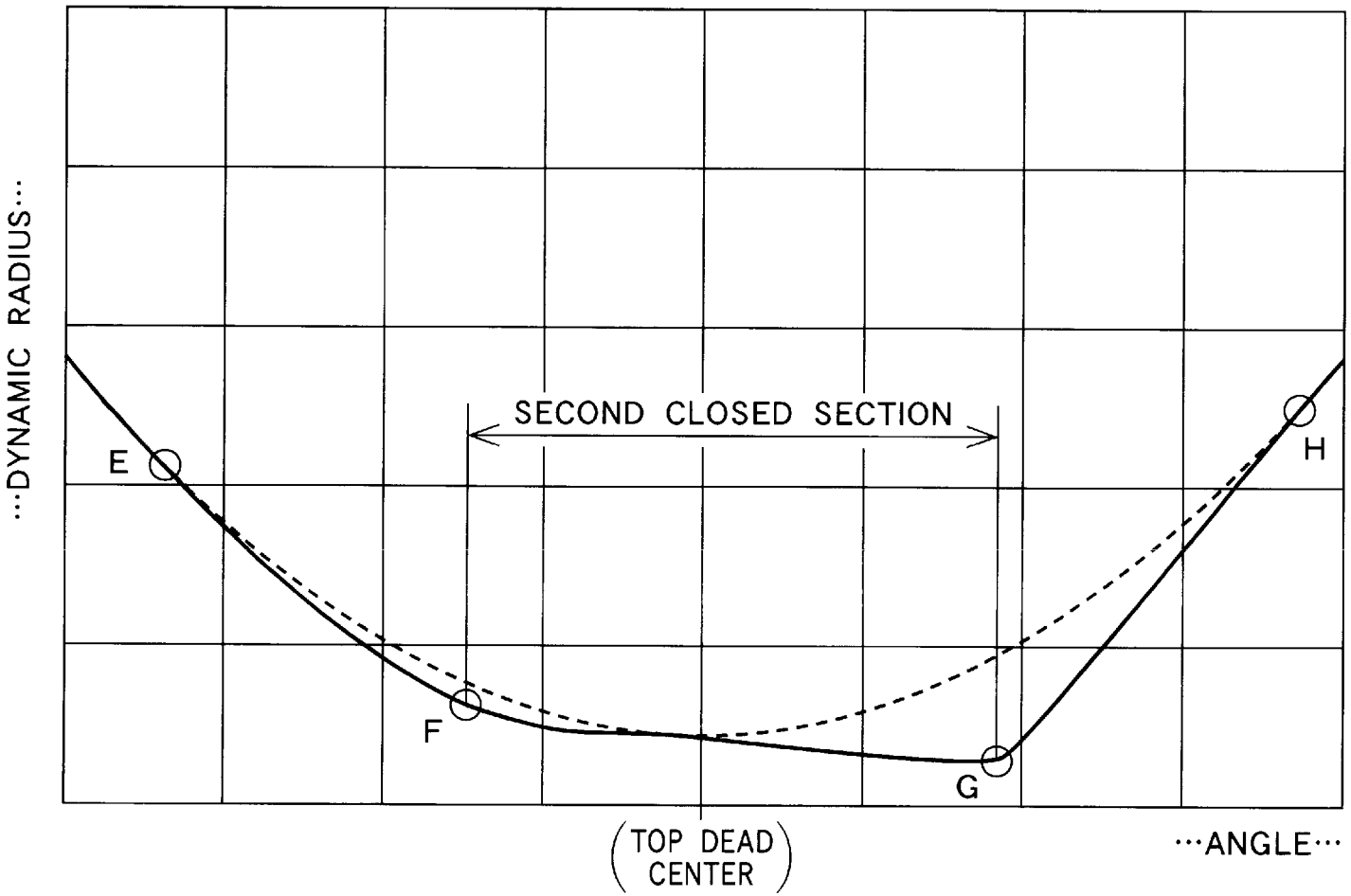
FIG. 8 is an expanded graph of a second closed section in the dynamic radius according to the first embodiment.

Solid lines in FIGS. 6 to 8 show a magnitude of a protruding radius (a dynamic radius) of the vane 17 with respect to the center O1 of the rotor 13 at which the front end of the vane 17 can be continuously in contact with the inner periphery of the cam ring 22 at respective angular positions in the peripheral direction of the cam ring 22, at a time of the maximum eccentricity of the cam ring 22 (at a time of the low speed rotation of the pump 10), in which A to B is a high-order curve, B to C is a negative slope curve, C to D is a high-order curve, D to E is a complete round curve, E to F is a high-order curve, F to G is a negative slope curve, G to H is a plurality of high-order curves connected to each other, and H to A is a complete round curve. In this case, broken lines in FIGS. 6 to 8 show the case of the cam ring constituted by a complete round curve in all around a whole periphery.

(Operation in First Closed Section 23A)

(1) When the vane 17 exists in the first closed section 23A, the high pressure in the side of the discharge port 27 is applied to the front surface of the vane 17 and the low pressure in the side of the suction port 24 is applied to the back surface of the vane 17, so that the vane 17 receives the offset load in the circumferential direction and is inclined at the root portion received in the groove 16 of the rotor 13 so as to be caught on. Accordingly, the vane 17 is always in contact with the negative slope curve B to C on the inner periphery of the cam ring in the first closed section 23A and is applied the centripetal motion entering into the groove 16 of the rotor 13. That is, the vane 17 is always pressed in the centripetal direction due to the contact of the cam ring with the inner periphery, and does not move apart from the inner periphery of the cam ring, so that it is possible to prevent the great pressure pulsation caused by the moving apart of the vane generated in the complete round cam ring, and it is possible to significantly reduce the vibration and the sound caused thereby.

(2) By smoothly connecting the negative slope curve B to C in the first closed section 23A to the complete round curve H to A or D to E in the discharge section or the suction section by the high-order curves A to B and C to D, the speed change of the vane in the connecting section becomes gentle (an acceleration becomes small) and it is possible to reduce a vibromotive force due to an inertia force of the vane, whereby it is possible to prevent the vibration and the sound of the pump caused by the shape change of the inner periphery of the cam ring.

(Operation in Second Closed Section 23B)

(1) When the vane 17 exists in the second closed section 23B, the high pressure in the side of the discharge port 27 is applied to the back surface of the vane 17 and the low pressure in the side of the suction port 24 is applied to the front surface thereof, so that the vane 17 receives the offset load in the circumferential direction and is inclined at the root portion received in the groove 16 of the rotor 13 so as to be caught on. Accordingly, the vane 17 is always in contact with the negative slope curve F to G on the inner periphery of the cam ring in the second closed section 23B and is applied the centripetal motion entering into the groove 16 of the rotor 13. That is, the vane 17 is always pressed in the centripetal direction due to the contact of the cam ring with the inner periphery, and does not move apart from the inner periphery of the cam ring, so that it is possible to prevent the great pressure pulsation caused by the moving apart of the vane 17.

(Second Embodiment) (FIGS. 5 and 9 to 13B)

Details of embodiments stated in claims 5 to 8 and a vane moving apart prevention operation of the cam ring shape according to the present invention are as described below.

The inner peripheral shape of the cam ring 22 is set as described in the following items (1) to (5). In FIG. 5, reference symbol O1 denotes a center position of the rotor 13, reference symbol O2 denotes a center position of an inner peripheral complete round portion of the ring 22, and reference symbol E denotes an amount of maximum eccentricity of the ring 22.

(1) In the rotational direction of the rotor 13 under the maximum eccentric state of the cam ring 22, in the suction section in a range that the vane is positioned at the suction port 24 and the discharge section in a range that the vane is positioned at the discharge port 27, the inner peripheral shape of the cam ring 22 is constituted by the complete round curves F to G and K to A (the center O2).

(2) In the first closed section 23A at a bottom dead center held between the suction section and the discharge section and in which the space between the adjacent vanes 17 and 17 is connected neither to the suction port 24 nor to the discharge port 27, the inner peripheral shape of the cam ring 22 is constituted by two curves (radius of curvature reducing curves on which the radius of curvature reduces along the rotational direction of the rotor 13) (hereinafter, refer to a negative slope curve) B to C and D to E capable of applying a centripetal motion that a protruding radius (a dynamic radius) of the vane 17 with respect to the center O1 of the rotor 13 progressively reduces together with an increase of the rotational angle of the rotor 13, and a second or more high-order curve C to D (a transient curve) smoothly connecting the negative slope curves B to C and D to E, in such a manner as to be always in contact with the front end of the vane 17 without relation to an amount of eccentricity E and freely press the vane 17 in the centripetal direction entering along the groove 16 of the rotor 13.

In this case, since it is possible to apply the centripetal motion to the vane even when the amount of eccentricity E becomes small in the high speed rotation area, the slope of the negative slope curve D to E constituting the rear half of the first closed section 23A is set to be larger than that of the negative slope curve B to C constituting the front half thereof.

(3) In the connecting portion connected to the suction section and the first closed section 23A, the inner peripheral shape of the cam ring 22 is constituted by a second or more high-order curve A to B (a transient curve) smoothly connecting a negative slope curve B to C in the first closed section 23A to a complete round curve K to A in the suction section. Further, it is constituted by a second or more high-order curve E to F (a transient curve) smoothly connecting a negative slope curve D to E in the first closed section 23A to a complete round curve F to G in the suction section.

(4) In the second closed section 23B at a top dead center held between the suction section and the discharge section and in which the space between the adjacent vanes 17 and 17 is connected neither to the suction port 24 nor to the discharge port 27, the inner peripheral shape of the cam ring 22 is constituted by two negative slope curves (radius of curvature reducing curves on which the radius of curvature reduces along the rotational direction of the rotor 13) G to H and I to J capable of applying a centripetal motion that a dynamic radius of the vane 17 with respect to the center O1 of the rotor 13 progressively reduces together with an increase of the rotational angle of the rotor 13, and a second or more high-order curve H to I (a transient curve) smoothly connecting the negative slope curves G to H and I to J, in such a manner as to be always in contact with the front end of the vane 17 without relation to an amount of eccentricity E and freely press the vane 17 in the centripetal direction entering along the groove 16 of the rotor 13.

In this case, the negative slope curve G to H constituting the front half of the second closed section 23B may be a complete round curve, and the slope of the negative slope curve I to J constituting the rear half may be small.

(5) In a connecting portion positioned at the end portion of the suction section and connected to the second closed section 23B, the inner peripheral shape of the cam ring 22 consists of a plurality of second or more high-order curves J to K (transient curves) smoothly connecting a negative slope curve I to J in the second closed section 23B to the complete round curve K to A in the suction section. In this case, since the high-order curves exist out of the second closed section 23B, no offset load is applied to the vane, and the moving apart of the vane is not generated even when the slope is positive.

Figure 9:
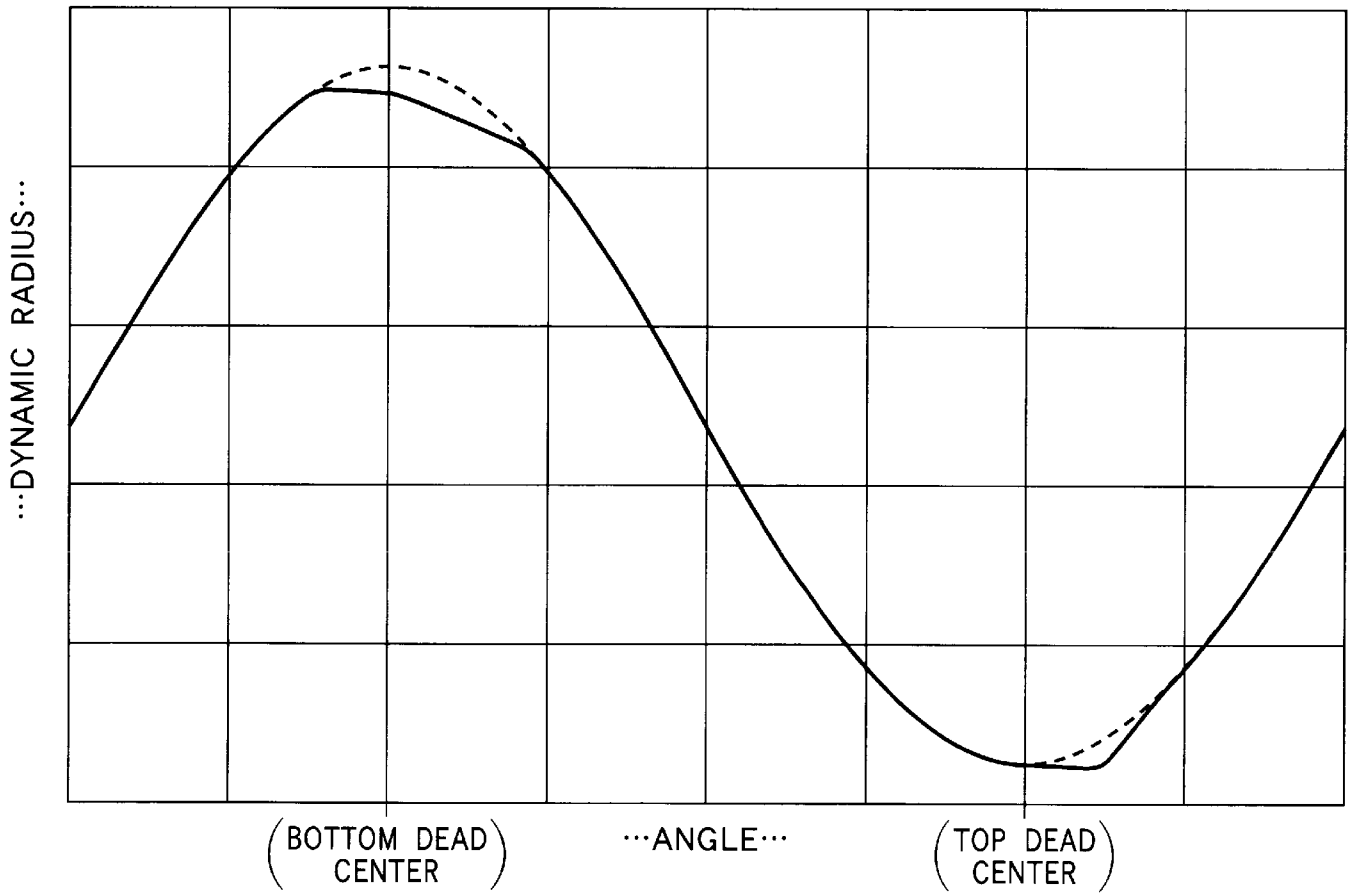
FIG. 9 is a graph showing a change of a radius (a dynamic radius) of a vane extending all the periphery of a cam ring according to a second embodiment.
Figure 10:
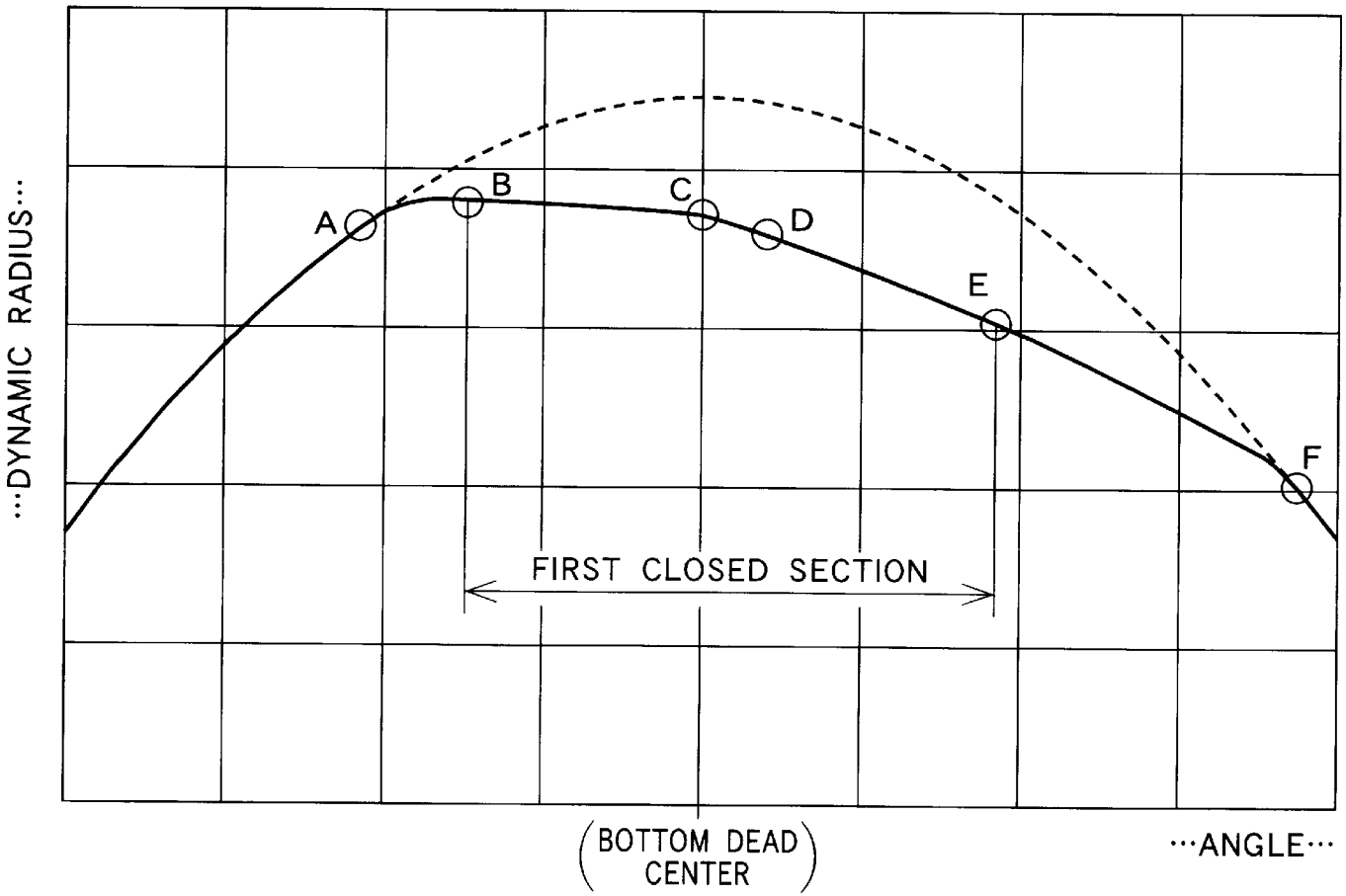
FIG. 10 is an expanded graph of a first closed section in the dynamic radius according to the second embodiment.
Figure 11:
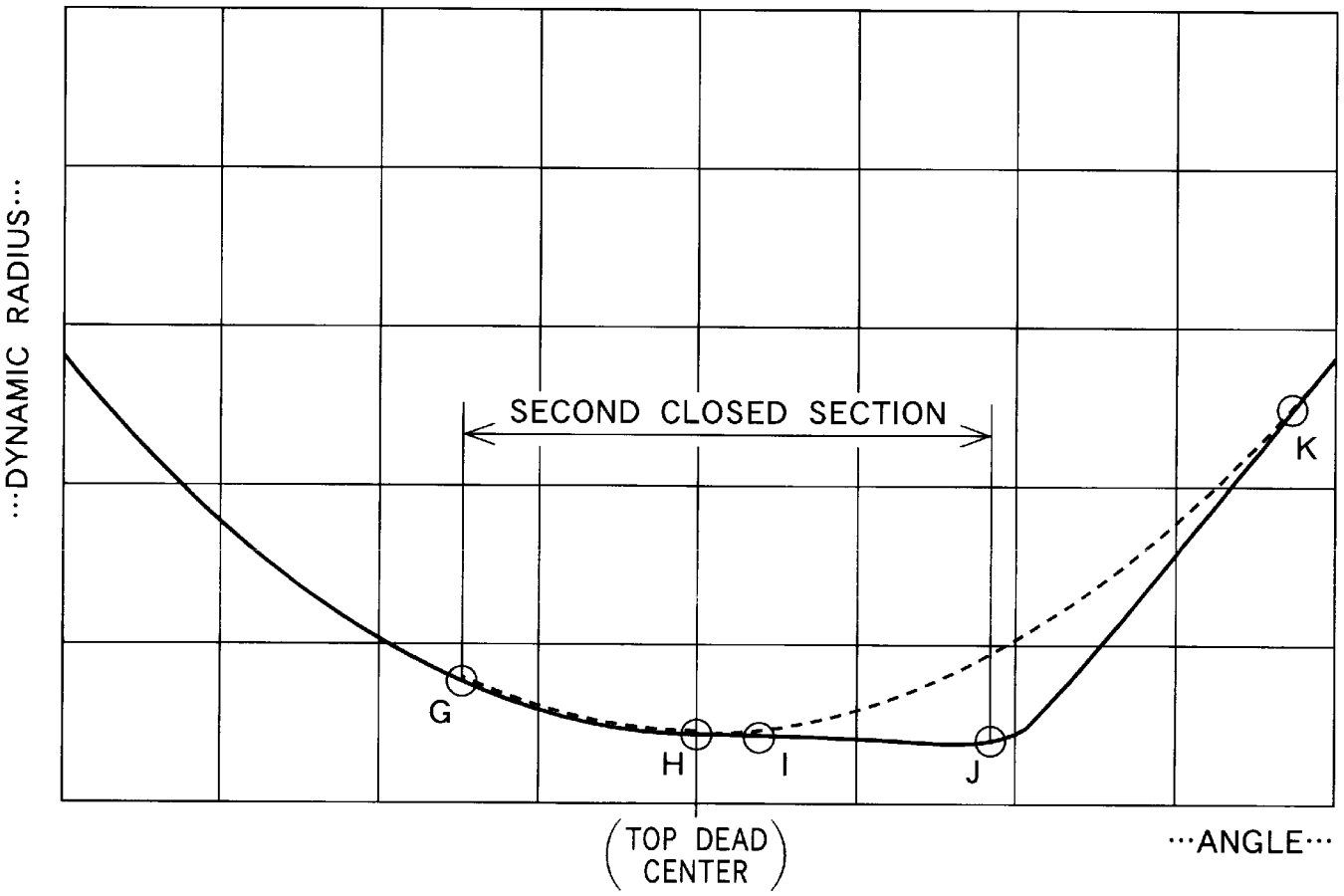
FIG. 11 is an expanded graph of a second closed section in the dynamic radius according to the second embodiment.

Solid lines in FIGS. 9 to 11 show a magnitude of a protruding radius (a dynamic radius) of the vane 17 with respect to the center O1 of the rotor 13 at which the front end of the vane 17 can be continuously in contact with the inner periphery of the cam ring 22 at respective angular positions in the peripheral direction of the rotor 13, at a time of the maximum eccentricity of the cam ring 22 (at a time of the low speed rotation of the pump 10), in which A to B is a high-order curve, B to C is a negative slope curve, C to D is a high-order curve, D to E is a negative slope curve, E to F is a high-order curve, F to G is a complete round curve, G to H is a negative slope curve, H to I is a high-order curve, I to J is a negative slope curve, J to K is a plurality of high-order curves, and K to A is a complete round curve. In this case, broken lines in FIGS. 9 to 11 show the case of the cam ring constituted by a complete round curve in all around a whole periphery.

Therefore, according to the second embodiment, the following operations can be obtained (FIGS. 12A to 14).

(Operation in First Closed Section 23A)

(1) When the vane 17 exists in the first closed section 23A, the high pressure in the side of the discharge port 27 is applied to the front surface of the vane 17 and the low pressure in the side of the suction port 24 is applied to the back surface of the vane 17, so that the vane 17 receives the offset load in the circumferential direction and is inclined at the root portion received in the groove 16 of the rotor 13 so as to be caught on. Accordingly, the vane 17 is always in contact with the negative slope curves B to C and D to E and the high-order curve C to D on the inner periphery of the cam ring in the first closed section 23A and is applied the centripetal motion entering into the groove 16 of the rotor 13. That is, the vane 17 is always pressed in the centripetal direction due to the contact of the cam ring with the inner periphery, and does not move apart from the inner periphery of the cam ring, so that it is possible to prevent the great pressure pulsation caused by the moving apart of the vane generated in the complete round cam ring, and it is possible to significantly reduce the vibration and the sound caused thereby.

(2) By smoothly connecting the negative slope curves B to C and D to E in the first closed section 23A to the complete round curve K to A or F to G in the discharge section or the suction section by the high-order curves A to B and E to F, the speed change of the vane in the connecting section becomes gentle (an acceleration becomes small) and it is possible to reduce a vibromotive force due to an inertia force of the vane, whereby it is possible to prevent the vibration and the sound of the pump caused by the shape change of the inner periphery of the cam ring.

(3) By differentiating the slopes of two negative slope curves B to C and D to E constituting the inner peripheral shape of the cam ring in the first closed section 23A (in particular, constituting the front half of the first closed section 23A by the negative slope curve B to C having a smaller slope and constituting the rear half by the negative slope curve D to E having a large slope), it is possible to prevent the vane 17 from moving apart in the first closed section 23A, in a wide drive range (a wide eccentric range of the cam ring) between the low speed rotation time of the pump 10 (the maximum eccentricity time of the cam ring) and the high speed rotation time (the minimum eccentricity time), so that it is possible to significantly reduce the pressure pulsation and the vibration and the sound of the pump caused thereby.

Figure 12A:
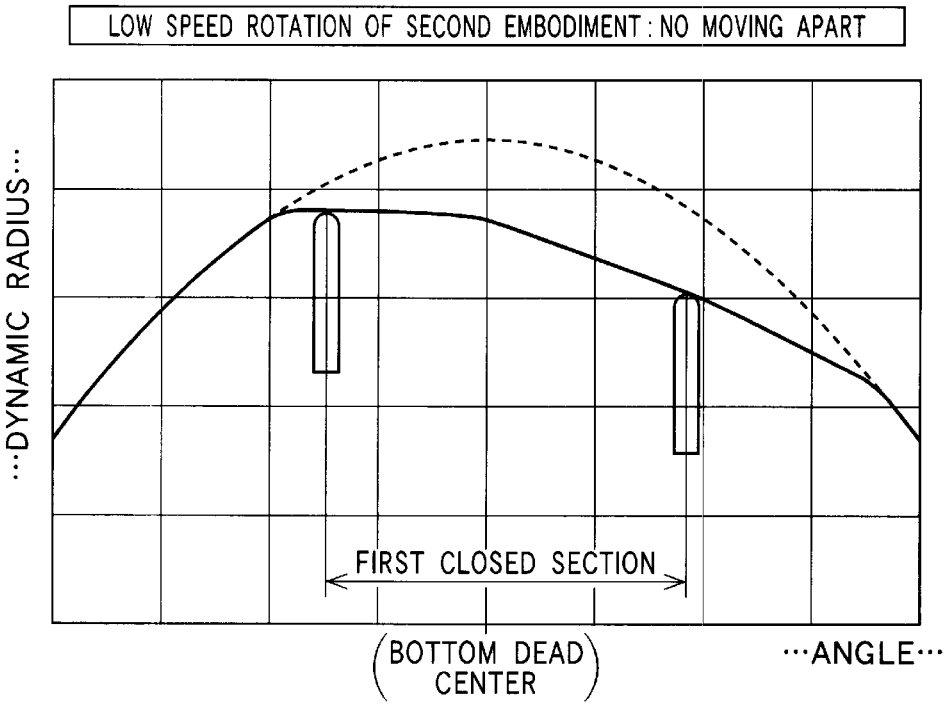
FIGS. 12A and 12B are views showing a vane moving apart prevention effect at a time of a low speed rotation and at a time of a high speed rotation in the first closed section according to the second embodiment.
Figure 12B:
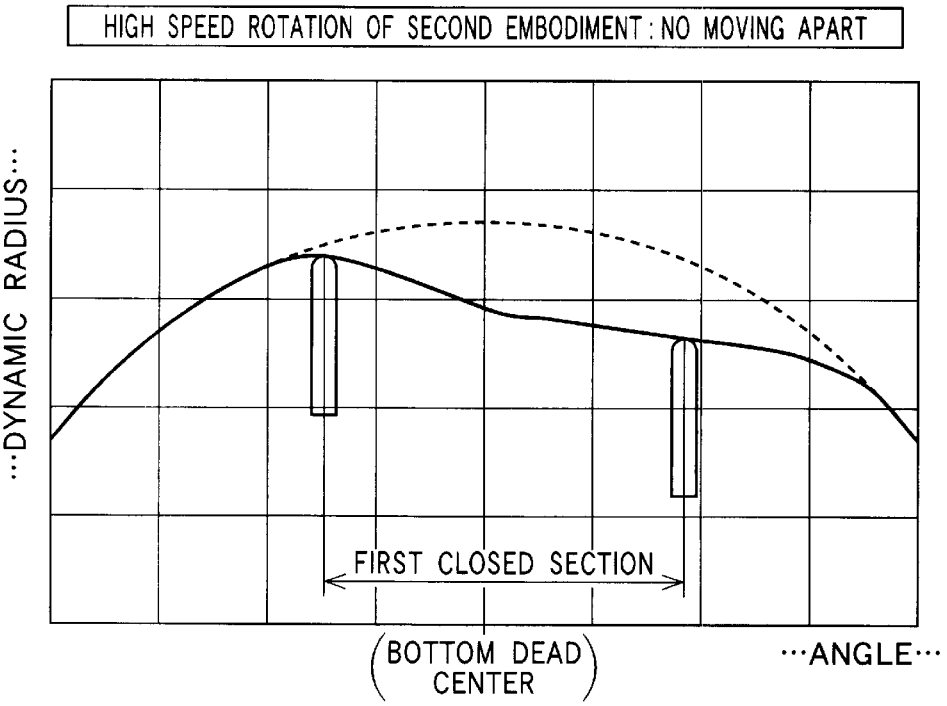

FIGS. 12A and 12B show a vane moving apart prevention effect of the cam ring provided with the negative slope curve according to the present invention, in the first closed section 23A, in which FIG. 12A shows that the vane 17 does not generate the moving apart in all the range between the front half of the first closed section 23A and the rear half at a time of the low speed rotation of the pump 10 (the maximum eccentricity time of the cam ring), and FIG. 12B shows that the cam ring maintains the shape in which the dynamic radius of the vane progressively reduces together with the rotation of the rotor even at a time of the high speed rotation of the pump 10 (at a time of the minimum eccentricity of the cam ring 22), and does not generate the moving apart in all the range between the front half of the first closed section 23A and the rear half.

(Operation in Second Closed Section 23B)

(1) When the vane 17 exists in the second closed section 23B, the high pressure in the side of the discharge port 27 is applied to the back surface of the vane 17 and the low pressure in the side of the suction port 24 is applied to the front surface thereof, so that the vane 17 receives the offset load in the circumferential direction and is inclined at the root portion received in the groove 16 of the rotor 13 so as to be caught on. Accordingly, the vane 17 is always in contact with the negative slope curves G to H and I to J on the inner periphery of the cam ring in the second closed section 23B and is applied the centripetal motion entering into the groove 16 of the rotor 13. That is, the vane 17 is always pressed in the centripetal direction due to the contact of the cam ring with the inner periphery, and does not move apart from the inner periphery of the cam ring, so that it is possible to prevent the great pressure pulsation caused by the moving apart of the vane 17.

(2) By differentiating the slopes of two negative slope curves G to H and I to J constituting the inner peripheral shape of the cam ring in the second closed section 23B (in particular, for example, constituting the front half of the second closed section 23B by the complete round curve or the negative slope curve G to H close thereto and constituting the rear half by the negative slope curve I to J having a comparatively small slope), it is possible to prevent the vane 17 from moving apart in the second closed section 23B, in a wide drive range (a wide eccentric range of the cam ring) between the low speed rotation time of the pump 10 (the maximum eccentricity time of the cam ring) and the high speed rotation time (the minimum eccentricity time of the cam ring), so that it is possible to significantly reduce the pressure pulsation.

Figure 13A:
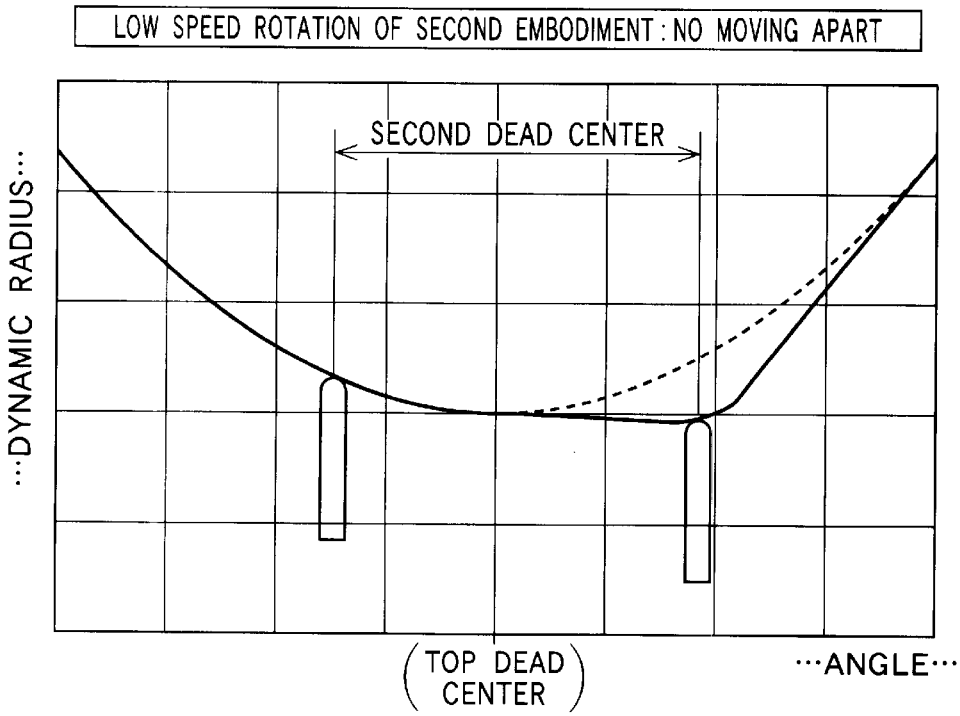
FIGS. 13A and 13B are views showing a vane moving apart prevention effect at a time of a low speed rotation and at a time of a high speed rotation in the second closed section according to the second embodiment.
Figure 13B:
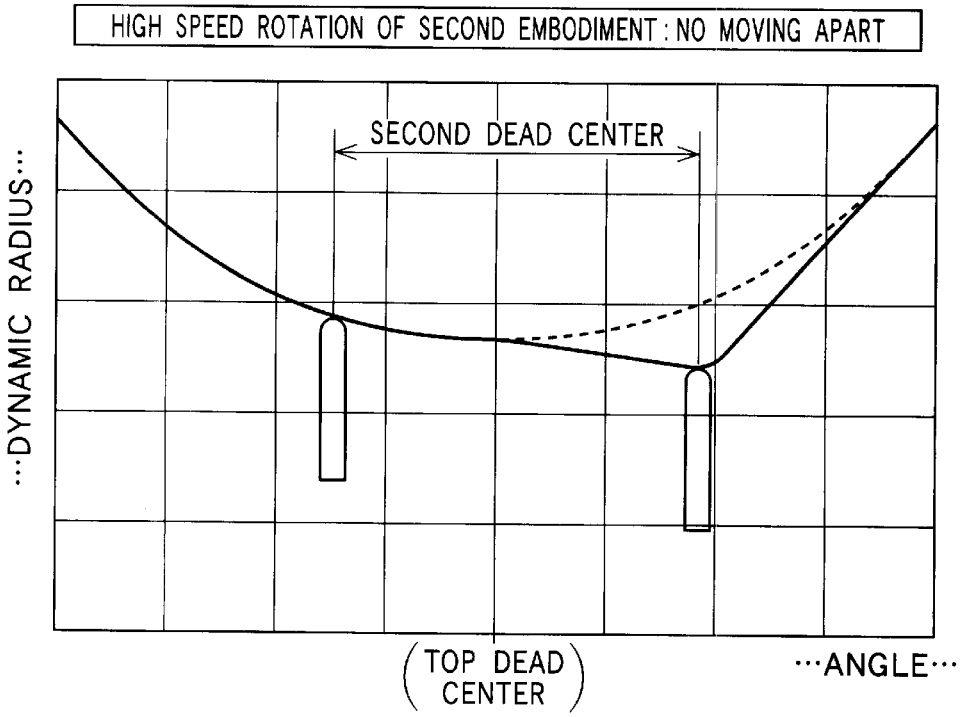

FIGS. 13A and 13B show a moving apart prevention effect of the vane 17 in the second closed section 23B, in which FIG. 13A shows that the vane 17 does not generate the moving apart in all the range between the front half of the second closed section 23B and the rear half at a time of the low speed rotation of the pump 10 (the maximum eccentricity time of the cam ring), and FIG. 13B shows that the cam ring maintains the shape in which the dynamic radius of the vane progressively reduces together with the rotation of the rotor even at a time of the high speed rotation of the pump 10 (at a time of the minimum eccentricity of the cam ring 22), and does not generate the moving apart in all the range between the front half of the second closed section 23B and the rear half.

In FIGS. 12A to 13B, the solid lines show a relation between the rotor rotational angle and the dynamic radius in the case of using the cam ring 22 according to the present embodiment, and the broken lines show a relation between the rotor rotational angle and the dynamic radius in the case of using the cam ring 22 on the basis of the complete round curve.

As heretofore explained, embodiments of the present invention have been described in detail with reference to the drawings. However, the specific configurations of the present invention are not limited to the embodiments but those having a modification of the design within the range of the present invention are also included in the present invention.

According to the present invention, in the closed section (the first closed section and the second closed section) in which the vane receives the offset load, since the front end of the vane is always pressed to the inner periphery of the cam ring without relation to the eccentric amount of the cam ring, no moving apart of the vane is generated, and it is possible to widely reduce the pressure pulsation induced by the intermittent leakage from the gap at the front end of the vane and the vibration and the sound generated together therewith, all around the wide operation range of the variable capacity type vane pump.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A variable capacity type pump comprising:

a pump casing;

a complete round rotor arranged in the pump casing so as to be rotated;

a cam ring arranged in a periphery of the rotor, forming a pump chamber with respect to an outer peripheral portion of the rotor and capable of being eccentric with respect to the rotor;

a suction port arranged in the pump casing and sucking a working fluid to the pump chamber;

a discharge port arranged in the pump casing and discharging the working fluid from the pump chamber;

a plurality of vanes received in a grooves of the rotor, protruding so as to freely move in a radial direction and being in contact with an inner periphery of the cam ring at front ends;

the working fluid sucked from the suction port being held in a space between the adjacent vanes, the working fluid being transferred due to a rotation of the rotor so as to be discharged from the discharge port; and a discharge amount of the working fluid being increased by increasing an eccentric amount of the cam ring with respect to the rotor, wherein the inner periphery of the cam ring is constituted by a shape of a suction section sucking the working fluid from the suction port, a shape of a first closed section at a bottom dead center transferring the working fluid sucked from the suction port to the discharge port after previously compressing, a shape of a discharge section discharging the working fluid from the discharge port, and a shape of a second closed section transferring the working fluid held in the space between the adjacent vanes at a top dead to the suction port, wherein the inner periphery of the cam ring in the suction section and the discharge section is constituted by a complete round curve and a transient curve, and wherein the inner periphery of the cam ring in the first and second closed section is constituted by a negative slope curve in which a radius of curvature reduces along the rotational direction of the rotor so as to always reduce a dynamic radius of the vane with respect to an increase of the rotational angle of the rotor without relation to the eccentric amount of the cam ring.

2. A variable capacity type pump as claimed in claim 1, wherein a shape of the cam ring is constituted by a negative slope curve in which a radius of curvature reduces along the rotational direction of the rotor so as to always reduce the dynamic radius of the vane with respect to the increase of the rotational angle of the rotor without relation to the eccentric amount of the cam ring, in the first closed section.

3. A variable capacity type pump as claimed in claim 2, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

4. A variable capacity type pump as claimed in claim 1, wherein a shape of the cam ring is constituted by a negative slope curve in which a radius of curvature reduces along the rotational direction of the rotor so as to always reduce the dynamic radius of the vane with respect to the increase of the rotational angle of the rotor without relation to the eccentric amount of the cam ring, in the second closed section.

5. A variable capacity type pump as claimed in claim 4, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

6. A variable capacity type pump as claimed in claim 1, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

7. A variable capacity type pump comprising:

a pump casing;

a complete round rotor arranged in the pump casing so as to be rotated;

a cam ring arranged in a periphery of the rotor, forming a pump chamber with respect to an outer peripheral portion of the rotor and capable of being eccentric with respect to the rotor;

a suction port arranged in the pump casing and sucking a working fluid to the pump chamber;

a discharge port arranged in the pump casing and discharging the working fluid from the pump chamber;

a plurality of vanes received in a grooves of the rotor, protruding so as to freely move in a radial direction and being in contact with an inner periphery of the cam ring at front ends;

the working fluid sucked from the suction port being held in a space between the adjacent vanes, the working fluid being transferred due to a rotation of the rotor so as to be discharged from the discharge port; and a discharge amount of the working fluid being increased by increasing an eccentric amount of the cam ring with respect to the rotor, wherein the inner periphery of the cam ring is constituted by a shape of a suction section sucking the working fluid from the suction port, a shape of a first closed section at a bottom dead center transferring the working fluid sucked from the suction port to the discharge port after previously compressing, a shape of a discharge section discharging the working fluid from the discharge port, and a shape of a second closed section transferring the working fluid held in the space between the adjacent vanes at a top dead to the suction port, wherein the inner periphery of the cam ring in the suction section and the discharge section is constituted by a complete round curve and a transient curve, and wherein the inner periphery of the cam ring in the first and second closed section is constituted by a plurality of negative slope curves in which a radius of curvature reduces along the rotational direction of the rotor so as to always reduce a dynamic radius of the vane with respect to an increase of the rotational angle of the rotor without relation to the eccentric amount of the cam ring.

8. A variable capacity type pump as claimed in claim 7, wherein a shape of the cam ring is constituted by a plurality of negative slope curves in which a radius of curvature reduces along the rotational direction of the rotor so as to always reduce the dynamic radius of the vane with respect to the increase of the rotational angle of the rotor without relation to the eccentric amount of the cam ring, in the first closed section.

9. A variable capacity type pump as claimed in claim 8, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

10. A variable capacity type pump as claimed in claim 7, wherein a shape of the cam ring is constituted by a plurality of negative slope curves in which a radius of curvature reduces along the rotational direction of the rotor so as to always reduce the dynamic radius of the vane with respect to the increase of the rotational angle of the rotor without relation to the eccentric amount of the cam ring, in the second closed section.

11. A variable capacity type pump as claimed in claim 10, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

12. A variable capacity type pump as claimed in claim 7, wherein a shape of the cam ring is make by setting a transient curve smoothly connecting the complete round curve in the suction section or the discharge section to the negative slope curve in the first closed section or the second closed section to a high-order curve, in both ends of the suction section or the discharge section, and a connecting portion to the first closed section or the second closed section.

* * * * *